US007293514B2

(12) United States Patent
Fukao

(10) Patent No.: US 7,293,514 B2
(45) Date of Patent: Nov. 13, 2007

(54) EMBROIDERY UNIT AND AUXILIARY COVER FOR SEWING MACHINE

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/390,112

(22) Filed: Mar. 28, 2006

(65) Prior Publication Data

US 2006/0219140 A1 Oct. 5, 2006

(30) Foreign Application Priority Data

Mar. 30, 2005 (JP) ..... 2005-098407

(51) Int. Cl.
*D05B 73/04* (2006.01)
*D05C 9/02* (2006.01)

(52) U.S. Cl. ..... 112/260; 112/103; 112/470.18

(58) Field of Classification Search ..... 112/260, 112/470.18, 103, 258, 470.06, 470.08; 150/164; 108/13, 43, 90
See application file for complete search history.

(56) References Cited

U.S. PATENT DOCUMENTS 3,188,993 A * 6/1965 Szuba et al. ..... 112/258
4,114,548 A * 9/1978 Kasahara et al. ..... 112/258
5,476,052 A * 12/1995 Kojima et al. ..... 112/260
5,906,168 A * 5/1999 Ito et al. ..... 112/103
6,019,052 A * 2/2000 Stucki et al. ..... 112/102.5
6,293,212 B1 * 9/2001 Ebata et al. ..... 112/103

FOREIGN PATENT DOCUMENTS

JP 402080083 A * 3/1990
JP A 11-114254 4/1999
JP A 2001-104672 4/2001
JP A 2002-52280 2/2002
JP A 2002-292169 10/2002
JP A 2004-121374 4/2004

* cited by examiner

*Primary Examiner*—Ismael Izaguirre
(74) *Attorney, Agent, or Firm*—Oliff & Berridge, PLC

(57) ABSTRACT

An embroidery unit of the present disclosure is detachably attached to a sewing machine bed including a feed dog mechanism having a feed dog. The embroidery unit includes an X-transfer mechanism and a Y-transfer mechanism moving an embroidery frame to an X-direction parallel to a lengthwise direction of the sewing machine bed and a Y-direction perpendicular to the X-direction respectively. The embroidery unit further includes an embroidery unit main body attached to the sewing machine bed either in an embroidery attachment position for performing embroidery sewing with an embroidery frame or in a normal sewing attachment position for performing a sewing operation by the feed dog of the cloth feed mechanism, and an auxiliary cover that is selectively placeable above the embroidery unit and selectively placeable below the embroidery unit.

22 Claims, 18 Drawing Sheets

EMBROIDERY UNIT AND AUXILIARY COVER FOR SEWING MACHINE

CROSS-REFERENCE TO RELATED APPLICATIONS

This application is based upon and claims the benefit of priority from the prior Japanese Patent Application No. 2005-098407, filed on, Mar. 30, 2005 the entire contents of which are incorporated herein by reference.

TECHNICAL FIELD

The present disclosure relates to an embroidery unit detachably attachable to a sewing machine bed and an auxiliary cover for a sewing machine.

BACKGROUND

Conventional embroidery units generally used are attached detachably to a sewing machine bed and includes an embroidery frame, a Y-carriage mechanism to which an embroidery frame is detachably attached, a Y-transfer mechanism moving the Y-carriage mechanism in a longitudinal direction (Y-direction) of the sewing machine bed and an X-transfer mechanism moving the Y-carriage mechanism to the lateral direction (X-direction) of the sewing machine bed with the Y-transfer mechanism. By attaching the embroidery unit to the sewing machine bed, the embroidery frame is transferred to the X and Y-directions forming an embroidery pattern on the work piece cloth retained by the embroidery frame.

JP-A-2002-52280 discloses an embroidery unit provided with a case having a flat upper surface and a longitudinally elongated movable case placed on the upper portion thereof. An X-direction transfer mechanism (corresponding to the X-transfer mechanism of the present disclosure) is installed in the case. A Y-carriage mechanism is placed on the upper portion of the case. A Y-direction transfer mechanism (corresponding to the Y-transfer mechanism of the present disclosure) and a part of the Y-carriage mechanism is installed in the movable case.

Since the Y-carriage mechanism and the movable case protrude from the upper surface of the embroidery unit, when normal sewing operation is performed with the embroidery unit attached, the Y-carriage and the movable case become an impediment. Thus, in case of performing a normal sewing operation, the embroidery unit needs to be removed from the main body of the sewing machine, requiring space to place the embroidery unit removed from the main body of the sewing machine.

SUMMARY

Therefore, the purpose of the present disclosure is to provide an embroidery unit capable of performing normal sewing operation with the embroidery unit attached to the sewing machine bed.

The embroidery unit of the present disclosure is detachably attached to a sewing machine bed provided with a cloth feed mechanism having a feed dog. The embroidery unit includes an X-transfer mechanism and a Y-transfer mechanism moving an embroidery frame in an X-direction parallel to a lengthwise direction of the sewing machine bed and a Y-direction perpendicular to the X-direction respectively. The embroidery unit also includes an embroidery unit main body attachable to the sewing machine bed in an embroidery attachment position in which embroidery sewing is performed by using an embroidery frame and a normal sewing attachment position, in which a sewing operation is performed by using the feed dog of the cloth feed mechanism, and an auxiliary cover that is selectively placeable above the embroidery unit and selectively placeable below the embroidery unit.

According to the above construction, since both embroidery and normal sewing can be performed with the embroidery machine main body attached to the sewing machine bed, no extra space is required to place the embroidery unit main body.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE PREFERRED EMBODIMENT

A first embodiment applying an embroidery unit according to the present disclosure to a household sewing machine will be described hereinafter with reference to FIGS. 1 to 14B.

Figure 1:
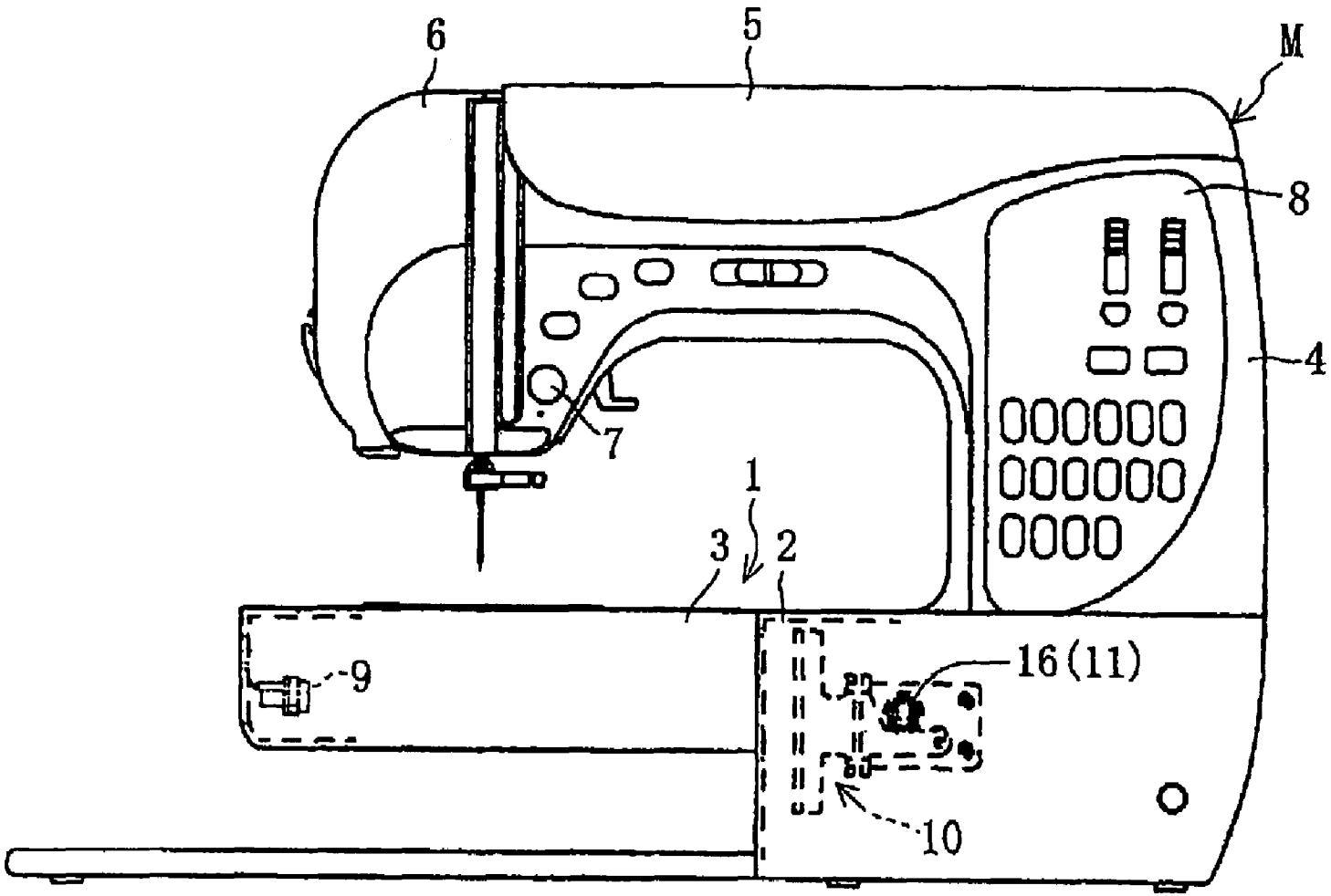
FIG. 1 is a front view indicating the first illustrative aspect of a sewing machine of the present disclosure.

As shown in FIG. 1, an electronic sewing machine M has a sewing machine bed 1, a foot 4, and an arm 5. Switches including a start/stop switch 7 are provided on the front surface of the arm 5. An operation panel 8 including various keys and volume control, and the like are provided on the front surface of the foot 4.

Also, though not shown, provided on a head 6 of the arm 5, as in an ordinary sewing machine, is a needle bar vertically moving mechanism vertically moving a needle bar having a sewing needle fixed to the lower end thereof, a needle swing mechanism, a thread take-up vertically moving mechanism, a presser foot mechanism including a presser bar having a presser foot mounted on the lower end thereof, and a thread tension mechanism, and the like.

As shown in FIGS. 1 to 4B, the sewing machine bed 1 has a bed main body 2 constituting the right half thereof and a free arm 3 extending leftward from the substantial center of the left end of the bed main body 2. The free arm 3 occupies approximately half of the longitudinal width of the bed main body 2.

The free arm 3 is provided with a cloth feed mechanism 23 including a cloth feeding feed dog 22, a thread hook (a horizontal hook or a vertical hook) not shown catching a needle thread in cooperation with the sewing needle, and systems for transmitting the drive force of the foregoing mechanisms. The cloth feed mechanism 23 includes a feed base 24 for placing the feed dog 22 thereon, a lower shaft 25 rotated in synchronization with a main shaft, a vertical feed cam 26 vertically moving the feed base 24 by being rotated by the lower shaft 25, and a feed regulator (not shown) that generates a horizontal movement (feed movement) in a longitudinal direction of the feed base 24.

Also, a switch member 27 slidable in the lateral direction is provided on the rear portion of the free arm 3, slightly displaced to the right from the mid portion thereof. The switch member 27 switches the feed dog 22 of the cloth feed mechanism 23 between a feed dog operating position capable of cloth feed, and a feed dog non-operating position incapable of cloth feed. An opening 3*a* is formed in the rear surface of the free arm 3 through which an operating end 27*a* of the switch member 27 protrude externally. When the switch member 27 is moved to a right position, the feed dog 22 assumes the feed dog non-operating position and when the switch member 27 is switched to a left position, the feed dog 22 assumes the feed dog operating position The switch member 27 is elastically biased to automatically return to the left position by a spring member not shown.

The embroidery unit 30 is detachably attached to the sewing machine bed 1. The embroidery unit 30 includes an embroidery unit main body 40 housing an X-transfer mechanism 42 and an X-carriage mechanism 44 therefor and a Y-transfer mechanism 51. A Y-carriage mechanism 53 is provided in the Y-transfer mechanism 51 and protrudes above the upper surface of the embroidery unit main body 40. The embroidery unit 30 further includes an auxiliary cover 70 selectively placeable above or below the embroidery unit main body 40 and attachable to the sewing machine bed 1 with the embroidery unit main body 40. The X-transfer mechanism 42 and the Y-transfer mechanism 51 that transfer an embroidery frame 61 in the X-direction parallel to the lengthwise direction of the sewing machine bed 1 and the Y-direction perpendicular to the X-direction respectively. The embroidery frame 61 is separated at a separation 61*a*. The separation 61*a* can be tightened by an operating screw member 61*b*.

The auxiliary cover 70 functions as an auxiliary table upon normal sewing.

Figure 3:
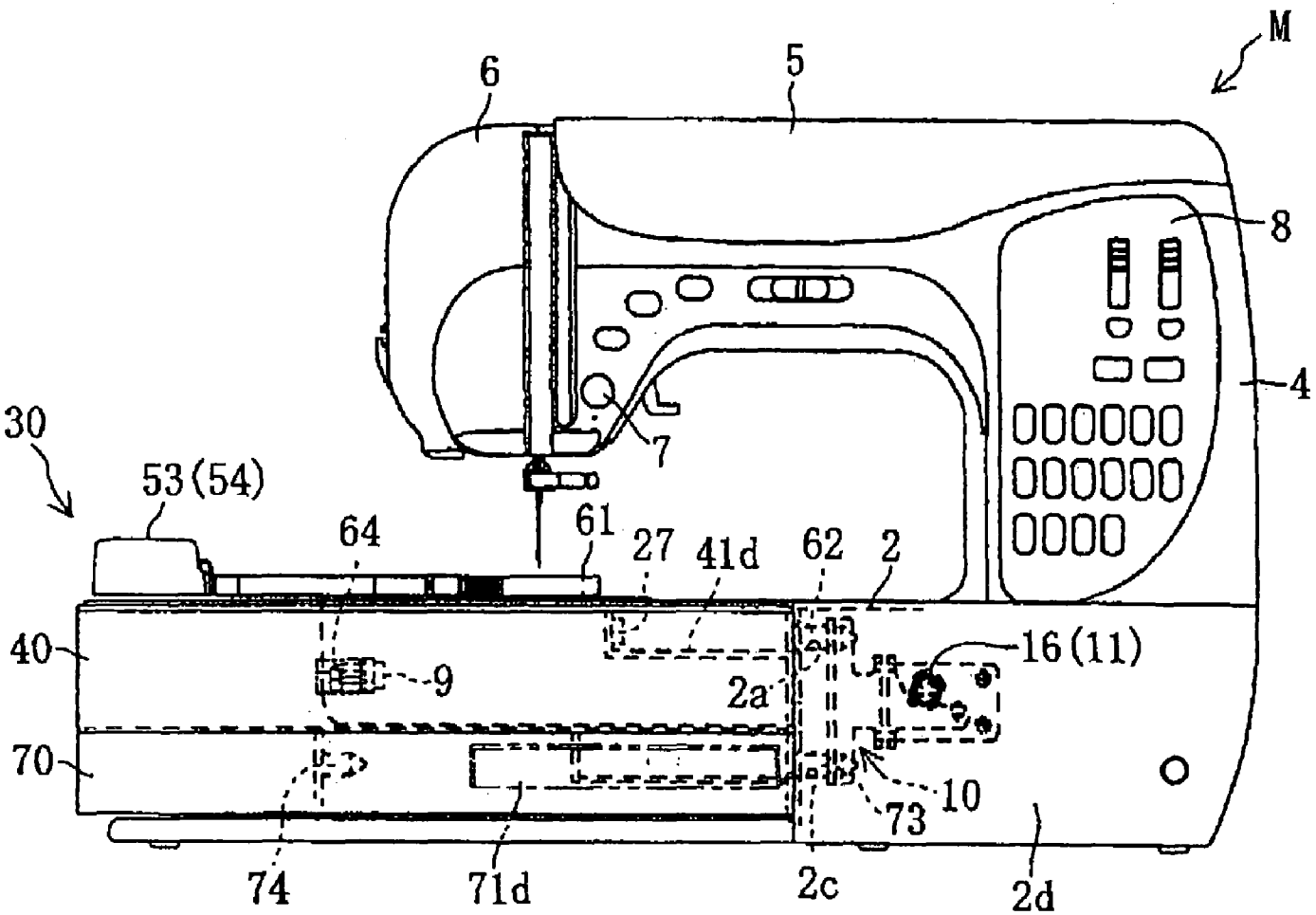
FIG. 3 is a front view of the sewing machine attached with an embroidery unit main body (embroidery attachment position) and an auxiliary cover.
Figure 4A:
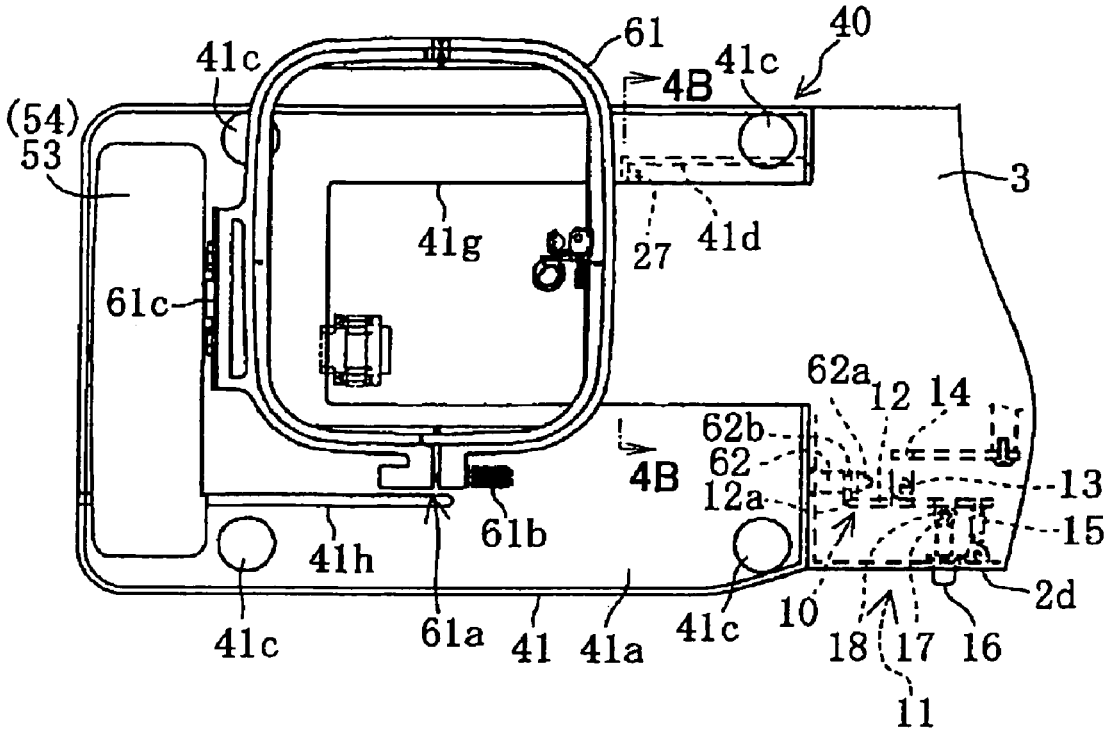
FIG. 4A is a plan view of a sewing machine bed attached with the embroidery unit main body.
Figure 4B:
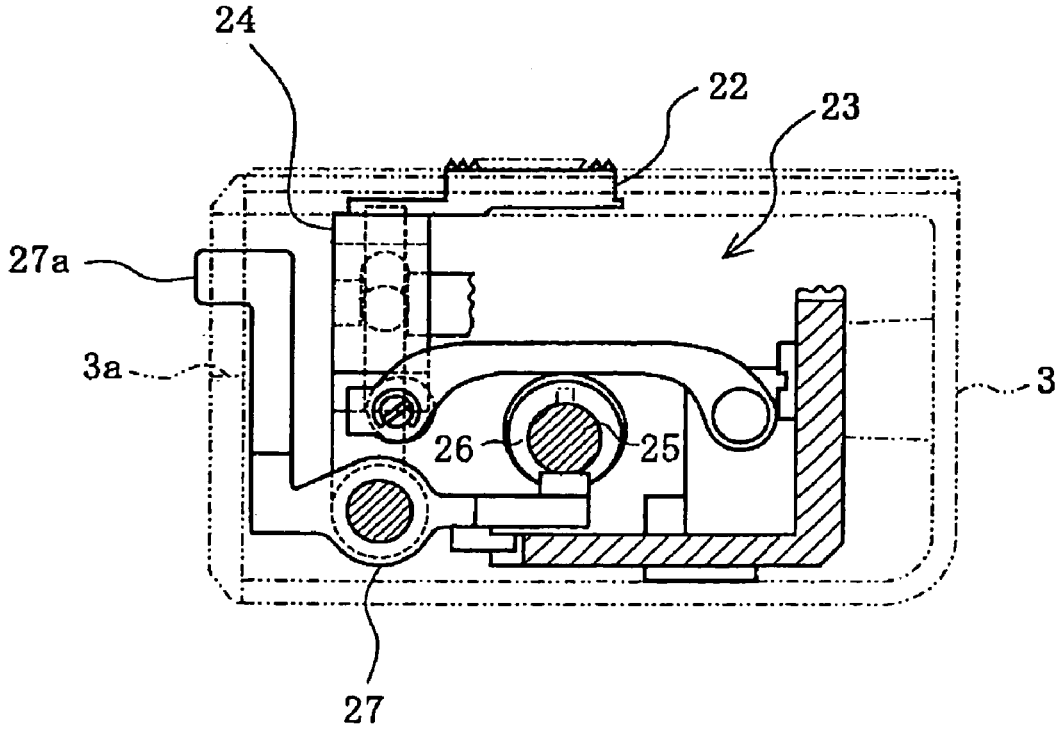
FIG. 4B is a vertical section view of the sewing machine bed taken along line 4B-4B in FIG. 4A.
Figure 5:
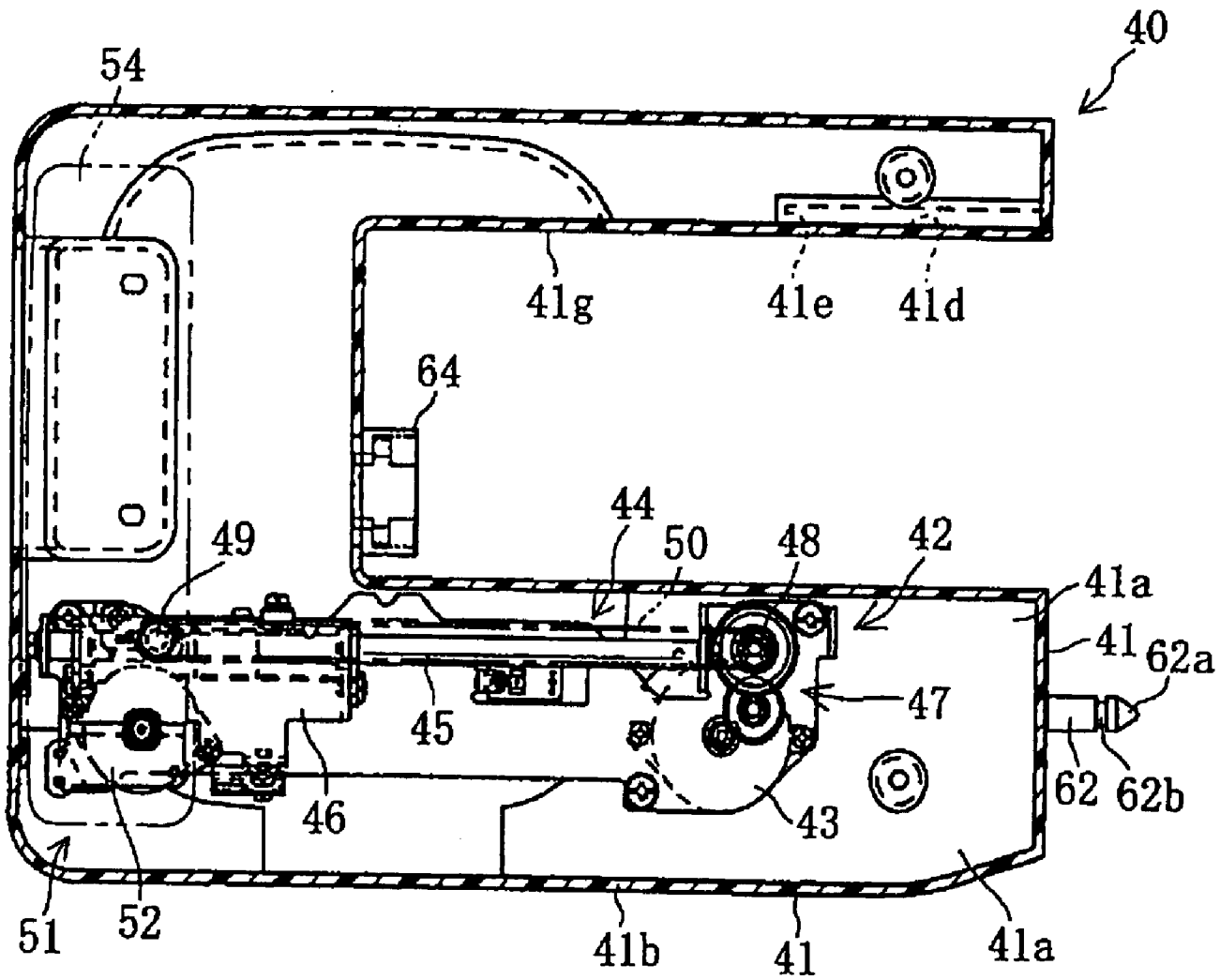
FIG. 5 is a transverse plan view of the embroidery unit main body.
Figure 6:
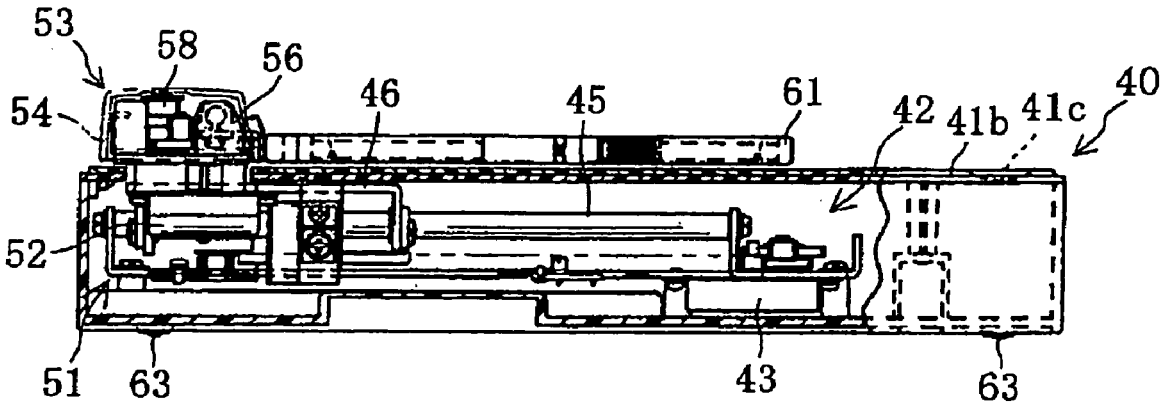
FIG. 6 is a partially broken front view of a vertical section of the embroidery unit main body.
Figure 7:
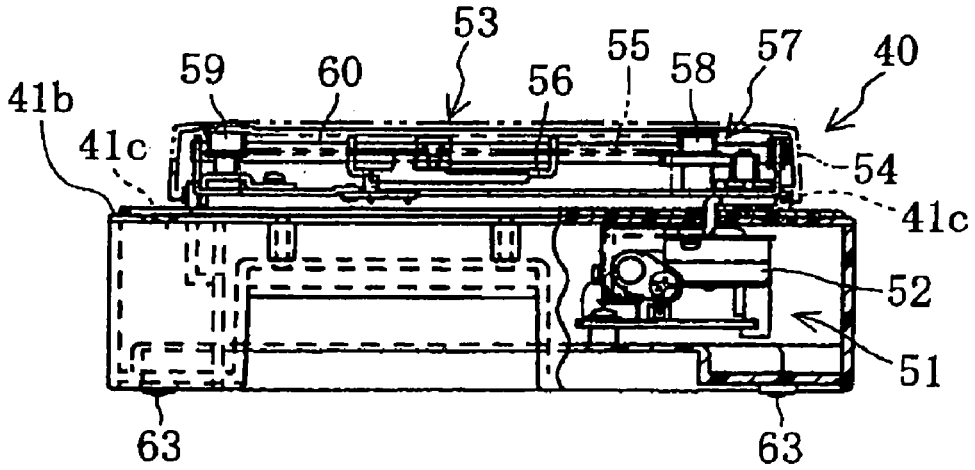
FIG. 7 is a partially broken side view of the embroidery unit main body.
Figure 12:
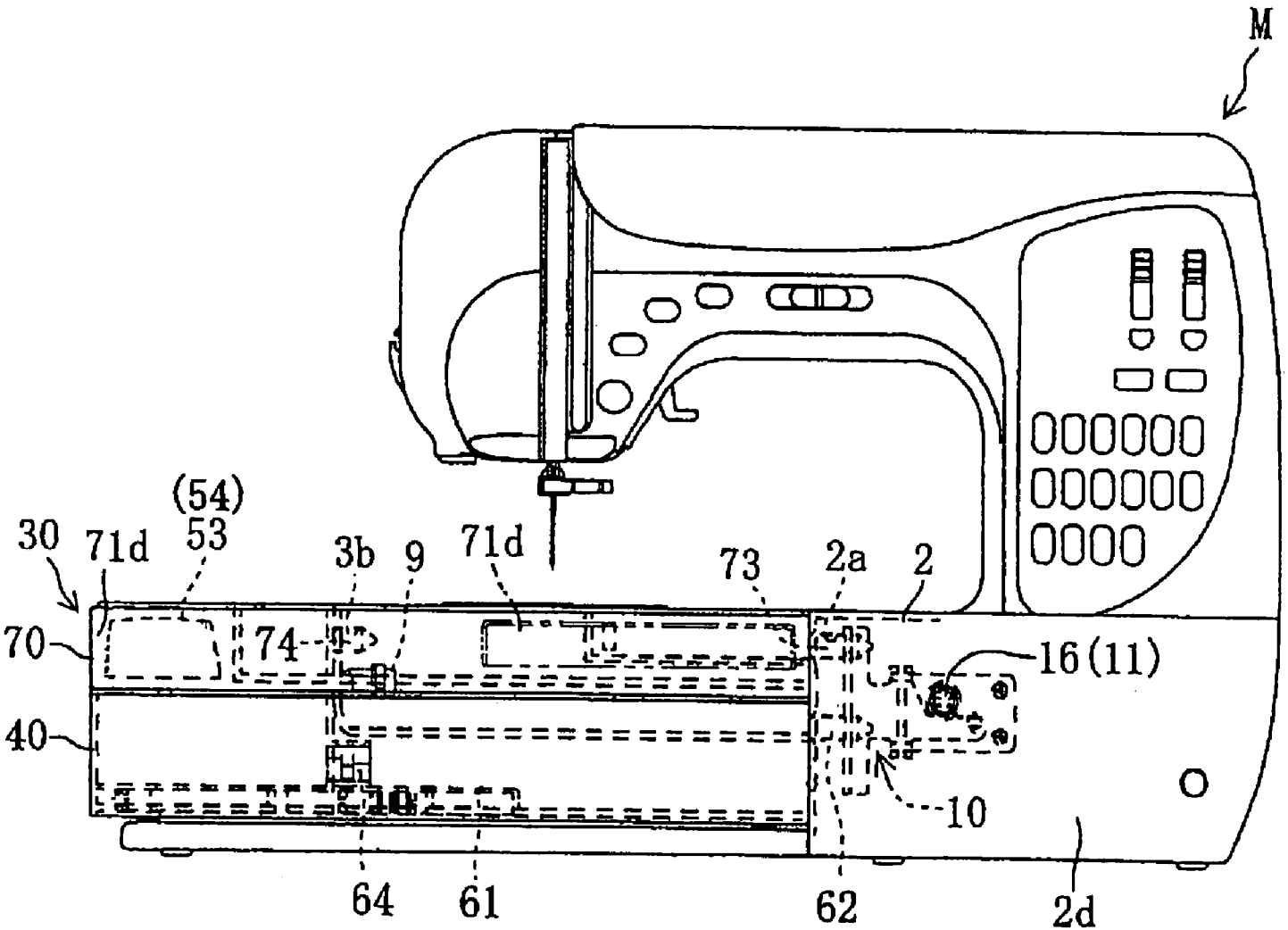
FIG. 12 is the front view of the sewing machine attached with the embroidery unit main body (normal sewing attachment position) and the auxiliary cover.
Figure 13:
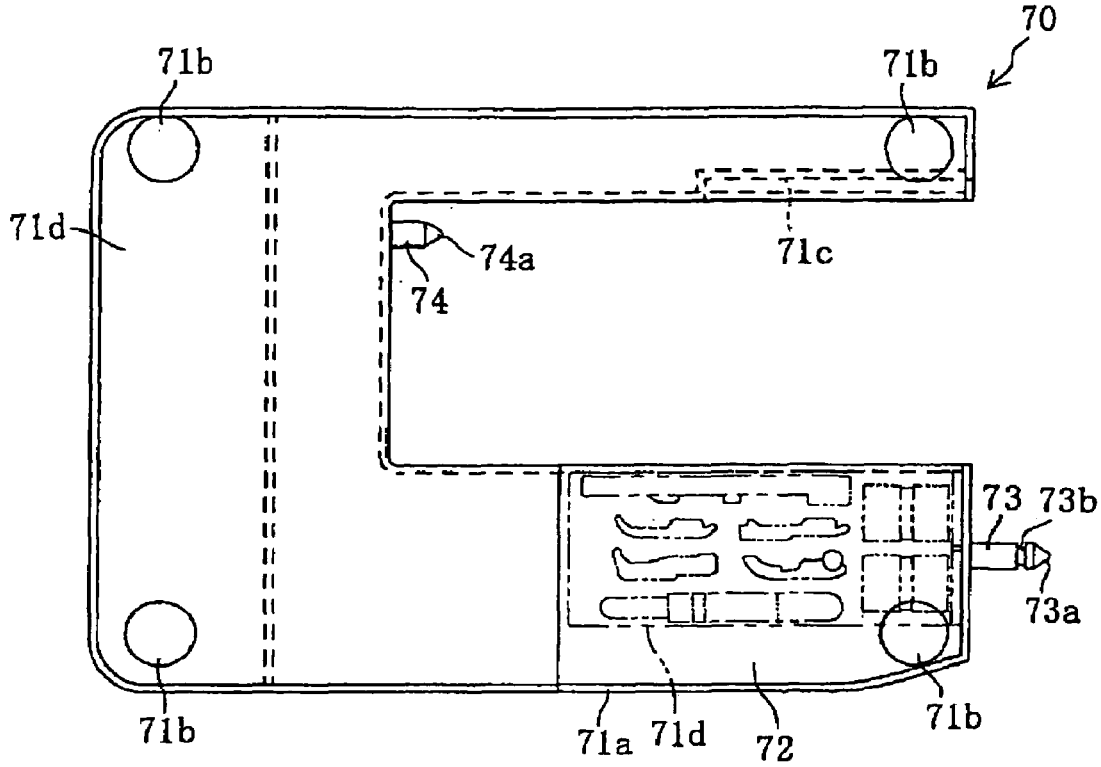
FIG. 13 is a plan view of the auxiliary cover.
Figure 14:
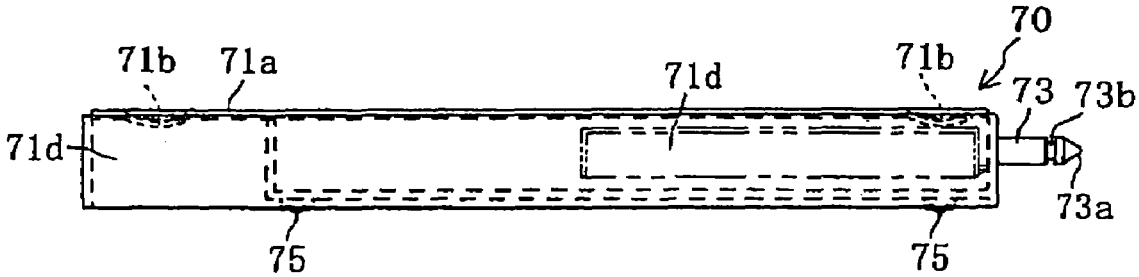
FIG. 14 is a front view of the auxiliary cover.

The embroidery unit main body 40 is attachable with respect to the sewing machine bed 1 either in an embroidery attachment position (as shown in FIG. 3) or in a normal sewing attachment position (as shown in FIG. 12). The normal sewing attachment position is lower than the embroidery attachment position by an amount of height of the auxiliary cover 70. The embroidery attachment position is a position for sewing embroidery with the embroidery frame 61. The normal sewing attachment position is a position for performing a sewing operation via a cloth feed rendered by the feed dog 22 of the cloth feed mechanism 23.

The upper surface of the embroidery unit main body 40 is substantially level with the upper surface of the sewing machine bed 1 when the embroidery unit main body 40 is attached in the embroidery attachment position. Also, when the embroidery unit main body 40 is attached in the normal sewing attachment position with the auxiliary cover 70 attached to the upper surface thereof, the upper surface of the auxiliary cover 70 is substantially level with the upper surface of the sewing machine bed 1.

Regarding the sewing machine bed 1, as shown in FIGS. 1 to 4, an electrical connector 9 connecting to an electrical connector 64 of the embroidery unit main body 40 when the embroidery unit main body 40 is attached to embroidery attachment position of the sewing machine bed 1 is provided on the lower portion of the left end of the free arm 3.

Figure 2:
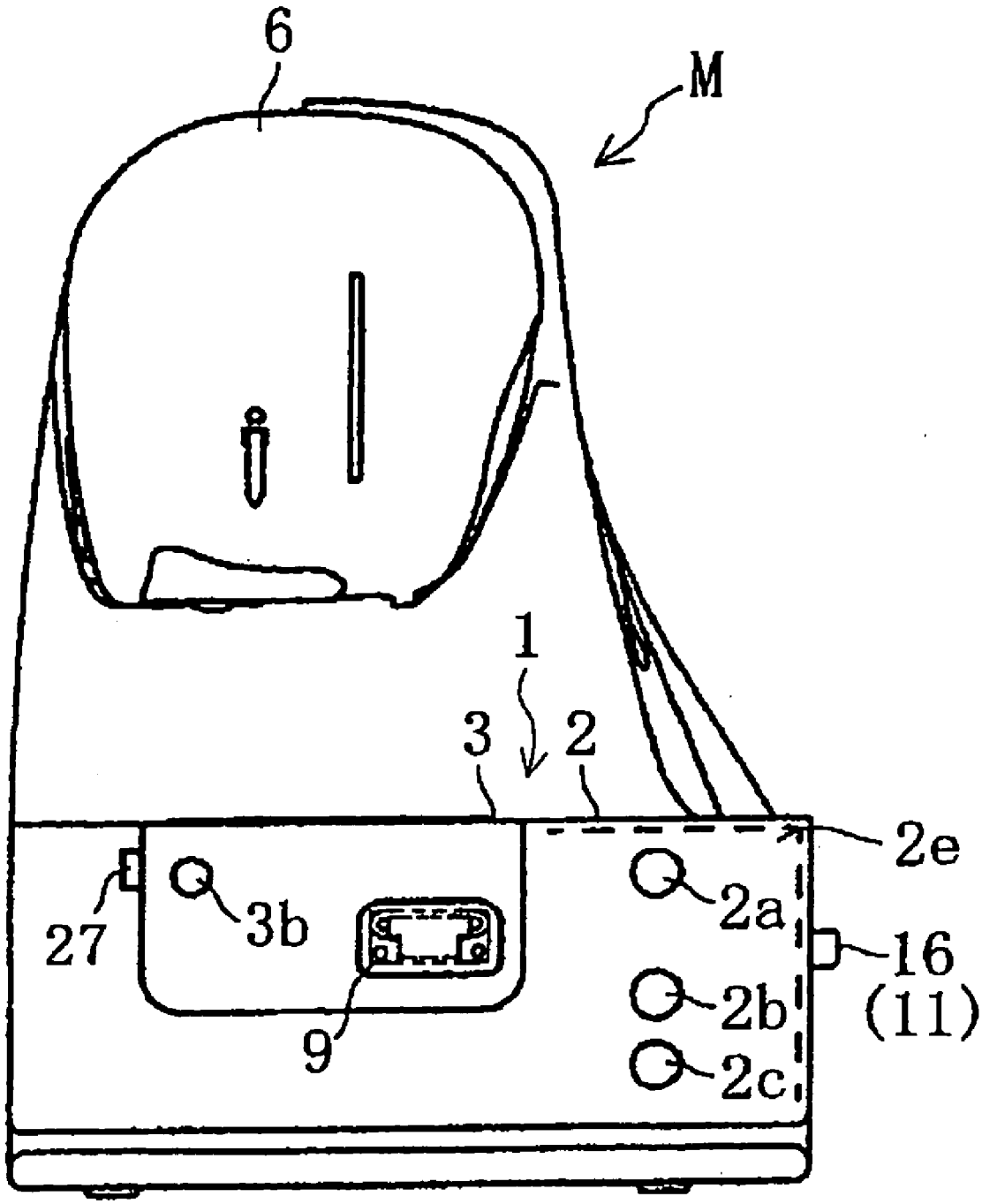
FIG. 2 is a left side view of the sewing machine.

As shown in FIG. 2, three engagement holes 2*a*, 2*b*, and 2*c* are formed on the front portion of a left end wall 2*e* of the bed main body 2 at different heights. When the embroidery unit main body 40 and the auxiliary cover 70 is attached to the sewing machine bed 1, two among the engagement holes 2*a*, 2*b* and 2*c* are engaged with engagement pin 62 (refer to FIG. 5) of the embroidery unit main body 40 and the engagement pin 73 (refer to FIG. 13) of the auxiliary cover 70.

Also, a lock mechanism 10 locking the engagement pins 62 and 73 engaged with the engagement holes 2*a*, 2*b* and 2*c* and a release mechanism 11 unlocking the lock mechanism 10 are provided inside the bed main body 2.

An operation button 16 of the release mechanism 11 protrudes to the front surface of the bed main body 2 (refer to FIGS. 3, 4, 11 and 12). The details of the lock mechanism 10 and the release mechanism 11 will be later described. The left end wall of the free arm 3 also has one engagement hole 3*b* engageable with the engagement pin 74 (refer to FIG. 11) of the auxiliary cover 70.

As shown in FIGS. 3 to 7, the longitudinal width of the embroidery unit main body 40 is slightly wider than the longitudinal width of the bed main body 2 and the lateral length of the embroidery unit main body 40 is approximately 1.5 times longer than the lateral length of the free arm 3. Also, the height of the embroidery unit main body 40 is approximately half of the height of the bed main body 2. An oblong arm-engagement portion 41*g* engaging with the free arm 3 is formed in a portion close to the rear of the right portion of the embroidery unit main body 40. Thus, the embroidery unit main body 40 is in a sidewardly oriented U-shape in plan view.

On the other hand, as shown in FIGS. 11 to 14, the auxiliary cover 70 is in a substantially same shape as the embroidery unit main body 40, and the height of the auxiliary frame 70 is approximately half the height of the embroidery unit main body 40.

Next, the X-transfer mechanism 42 and the Y-transfer mechanism 51 provided on the embroidery unit main body 40 will be described based on FIGS. 3 to 7. The X-transfer mechanism 42 is arranged inside the front portion of the embroidery unit main body 40. The X-transfer mechanism 42 has an X drive motor 43 composed of a stepping motor and a laterally elongated X-carriage mechanism 44. The X-drive motor 43 is mounted on the bottom of a casing 41 of the embroidery unit main body 40. The X-carriage mechanism 44 includes a substantially horizontal guide shaft 45 extending in the X-direction (lateral direction); an X-carriage 46 guided by the guide shaft 45 and movable in the X-direction; and a decelerating gear mechanism 47 rotated by the X-drive motor 43. The X-carriage mechanism 44 further includes a pulley 48 and a follower pulley 49 rotated by the decelerating gear mechanism 47 and a timing belt 50 disposed around the pulley 48 and the follower pulley 49 and connected to the X-carriage 46. Under such construction, the X-carriage mechanism 44 moves the X-carriage 46 in the X-direction by the rotational drive power of the X drive motor 43.

The Y-transfer mechanism 51 includes a Y-drive motor 52 composed of a stepping motor mounted on the X-carriage 46, the Y-carriage mechanism 53 supported by the X-carriage 46 so as to protrude above the upper surface of the embroidery unit main body 40, and a movable case 54 made of synthetic resin covering the external surface of the Y-carriage mechanism 53.

The Y-carriage mechanism 53 is elongated in the Y-direction (longitudinal direction) and includes a guide shaft 60 arranged substantially horizontally in the Y-direction; a Y-carriage 56 movable in the Y-direction by being guided by the guide shaft 60; and a decelerating gear mechanism 57 rotated by the Y drive motor 52. The Y-carriage mechanism 53 further includes a pulley 58 and a follower pulley 59 rotated by the decelerating gear mechanism 57; and a timing belt 55 connected to the Y-carriage 56 and disposed around the pulley 58 and the follower pulley 59. Thus, the Y-carriage mechanism 53 drives the Y-carriage 56 in the Y-direction by the drive force of the Y drive motor 52.

A connection portion (not shown) to which a connection portion 61*c* of the embroidery frame 61 is detachably connected is provided on the Y-carriage 56. A slit 41*h* oriented rightward from the left end of the embroidery unit main body 40 is defined on the front portion of the embroidery unit main body 40 upper surface. A connection portion (not shown) for the X-carriage mechanism 44 for moving the Y-carriage mechanism 53 in the X-direction protrudes upward from the slit 41*h*.

Next, the embroidery unit main body 40 and the auxiliary cover 70 will be described in detail.

As shown in FIGS. 3, 4A, and 8 to 10, the embroidery unit main body has the casing 41 made of synthetic resin and four foot portions 63. The upper surface of an upper surface plate 41*a* of the casing 41 is formed as a flat surface so as to be used as a work table along with the sewing machine bed 1 upper surface. An engagement recess (outer peripheral engagement portion) 41*b* is formed as a lowered step on the upper end of the outer peripheral edge of the casing 41. Four recesses 41*c* are formed on the upper surface of the upper plate 41*a* of the casing 41. Also, an engagement projection (outer peripheral engagement portion) 41*i* is formed on the lower end of the outer peripheral edge of the casing 41.

On the other hand, as shown in FIGS. 11 to 14, the auxiliary cover 70 has a casing 71 made of synthetic resin and four foot portions 75. The upper surface of an upper surface plate of the casing 71 is formed as a flat surface so as to be used as a work table along with the sewing machine bed 1 upper surface. An engagement recess (outer peripheral engagement portion) 71*a* is formed as a lowered step on the upper end of the outer peripheral edge of the casing 71. Four recesses 71*b* are formed on the upper surface of the upper plate of the casing 71. Also, an engagement projection (outer peripheral engagement portion) 71*i* is formed on the lower end of the outer peripheral edge of the casing 41.

When the auxiliary cover 70 is placed atop the embroidery unit main body 40, the engagement projection 71*i* of the auxiliary cover 70 is engaged with the engagement recess 41*b* of the embroidery unit main body 40. Also, each of the four foot portion 75 of the auxiliary cover 70 is accommodated by the four recesses 41*c* of the embroidery unit main body 40 respectively. As opposed to this, when the embroidery unit main body 40 is placed atop the auxiliary cover 70, the engagement recess 71*a* of the auxiliary cover 70 is engaged with the engagement projection 41*i* of the embroidery unit main body 40. Also, the four foot portions 63 of the embroidery unit main body 40 are accommodated by the four recesses 71*b* of the auxiliary cover 70 respectively.

Figure 8:
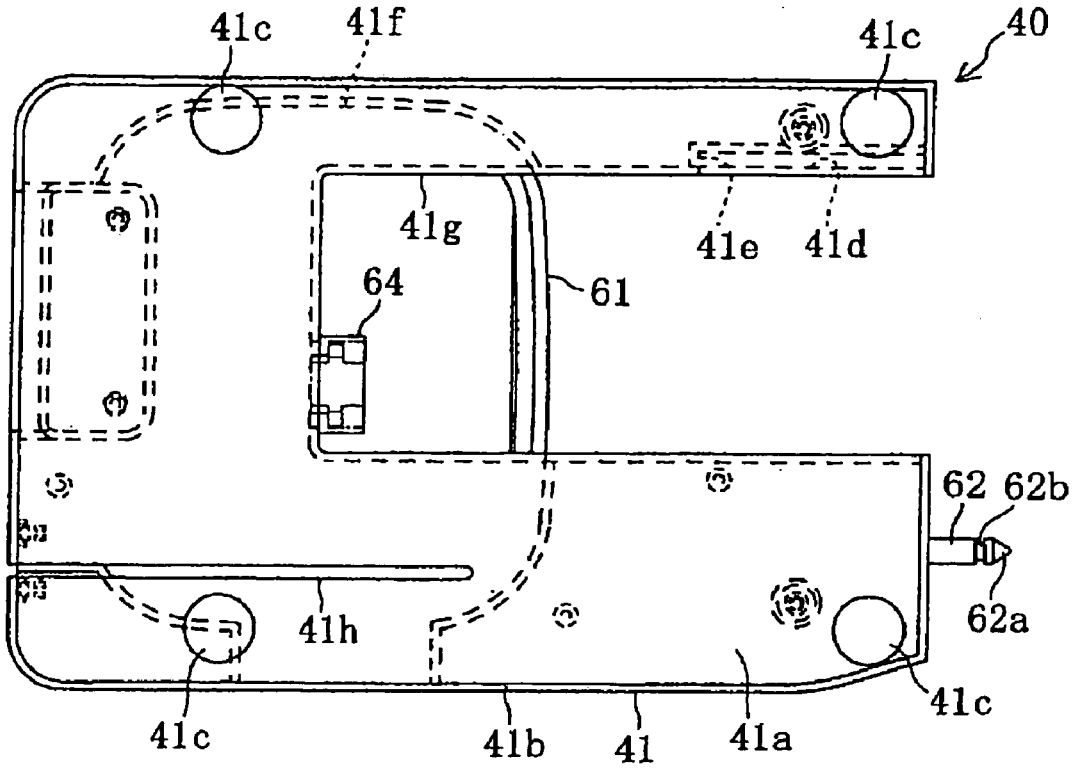
FIG. 8 is a plan view of the embroidery unit main body.
Figure 10:
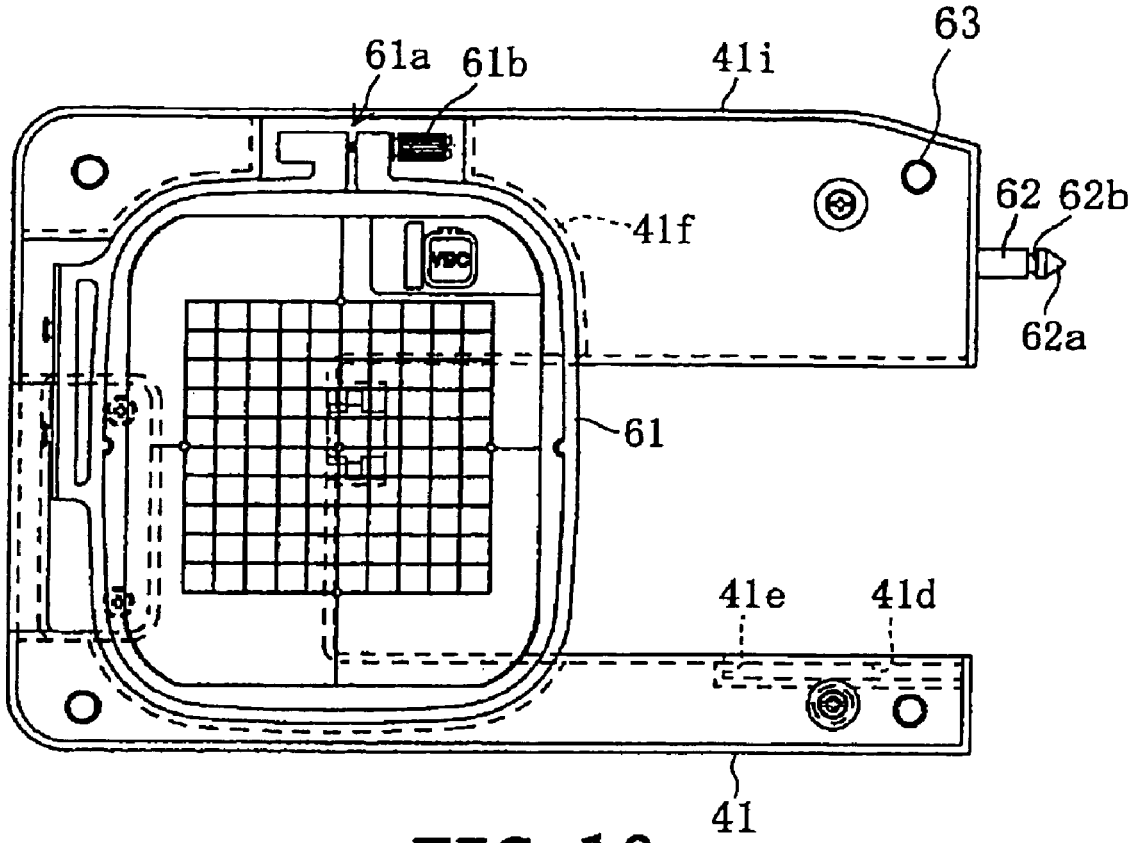
FIG. 10 is a bottom view of the embroidery unit main body.

As shown in FIGS. 8 and 10, a horizontal groove 41*d* opened to the arm engagement portion 41*g* is formed on the rear right end portion of the casing 41 of the embroidery unit main body 40. A locking wall 41*e* is formed in the left end of the horizontal groove 41. As shown in FIG. 4, when the embroidery unit main body 40 is attached to the embroidery attachment position (refer to FIG. 3) of the sewing machine bed 1 with the auxiliary cover 70 attached to the underside of the embroidery unit main body 40, the switch member 27 of the free arm 3 is disposed in the horizontal groove 41*d*. At this point, the switch member 27 is switched to the right position by the locking wall 41*e*, and the feed dog 22 is dropped to the feed dog non-operating position. As opposed to this, when the embroidery unit main body 40 and the auxiliary cover 70 is removed from the sewing machine bed 1, the switch member 27 is returned to the left position by the bias of the spring member and the feed dog 22 assumes the feed dog operating position.

Figure 11:
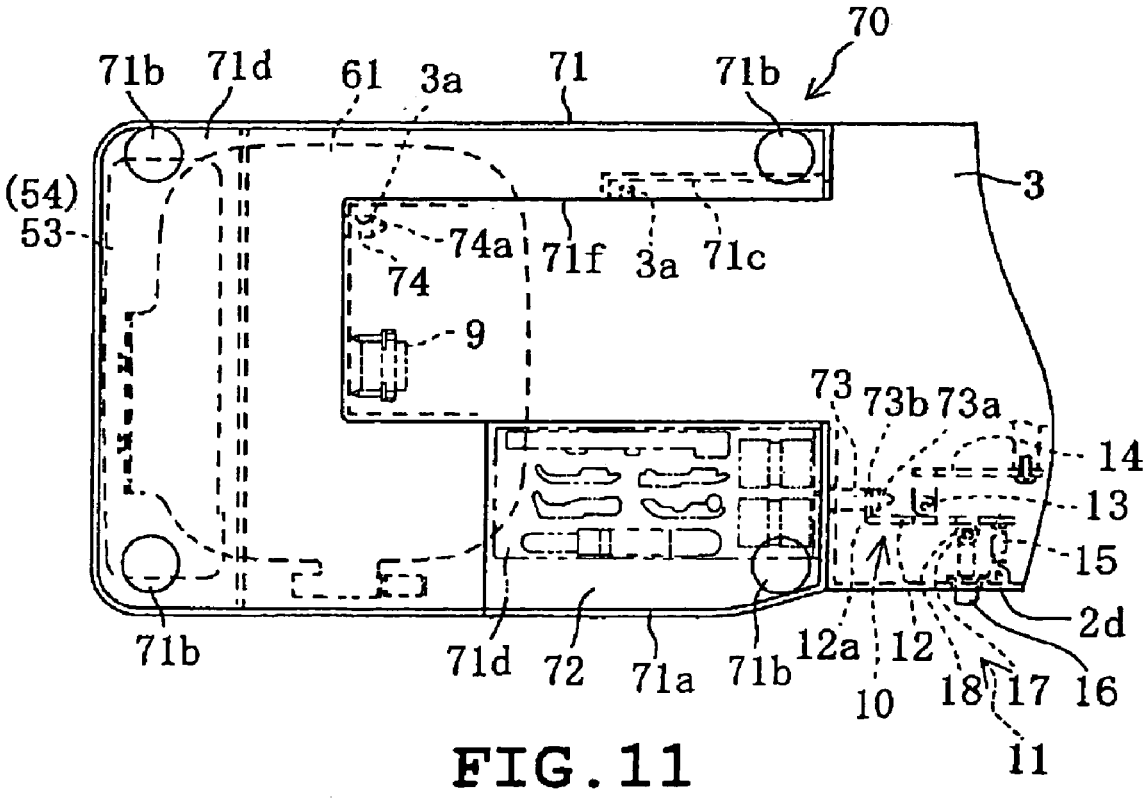
FIG. 11 is a plan view of the sewing machine bed attached with the auxiliary cover and the embroidery unit main body.

As shown in FIG. 11, a horizontal groove 71*c* corresponding to the horizontal groove 41*d* is formed on the rear portion of the casing 71 of the auxiliary cover 70, slightly displaced to the right from the mid portion thereof. A locking wall (not shown) corresponding to the locking wall 41*e* of the horizontal groove 41*d* is provided on the left end of the horizontal groove 71*c*. The switching member 27 is introduced to the horizontal groove 71*c*. When the embroidery unit main body 40 is attached to the normal sewing attachment position (refer to FIG. 12) of the sewing machine bed 1 with the auxiliary cover 70 attached to the upper surface of the embroidery unit main body 40, the switch member 27 is disposed inside the horizontal groove 71*c*. At this point, the locking wall of the casing 71 does not press the switch member 27 to the right. Therefore, the switch member 27 is maintained to the left position and the feed dog 22 is maintained in the feed dog operating position.

Figure 9:
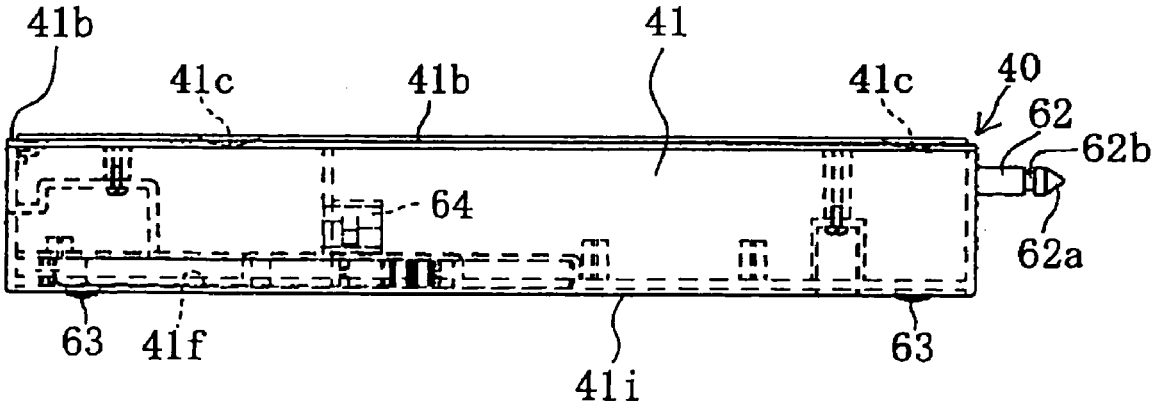
FIG. 9 is a front view of the embroidery unit main body.

As shown in FIG. 8 to 10, a flat storage 41*f* (corresponding to the second storage) is formed for storing the embroidery frame 61 near the lower end of the left half of the embroidery unit main body 40. The lower portion of the storage 41*f* is opened and the upper surface of the storage 41*f* is enclosed by the bottom wall of the casing 41. The storage 41*f* is formed so that the embroidery frame 61 which is a standard accessory is fitted therein. The embroidery frame 61 is locked and stored into the storage 41*f* by being lightly fitted thereto by lightly tightening the separation 61*a* by the operation screw member 61*b*.

As shown in FIGS. 8 to 12, an engagement pin 62 protruding horizontally to the right is provided near the upper end of the right end wall in the front portion of the casing 41 of the embroidery unit main body 40. A conical guide portion 62*a* is formed on the distal end of the engagement pin 62, and an annular groove 62*b* engaged with the engagement plate 12*a* of the lock plate 12 of the lock mechanism 10 is formed to the immediate left of the guide portion 62*a*. When the embroidery unit main body 40 is attached in the embroidery attachment position (refer to FIG. 3), the engagement pin 62 is engaged with the uppermost engagement hole 2*a* of the bed main body 2. On the other hand, when the embroidery unit main body 40 is attached in the normal sewing attachment position (refer to FIG. 12), the engagement pin 62 is engaged with the mid engagement hole 2*b* of the bed main body 2.

As shown in FIGS. 11 to 14, a storage 71*d* (corresponding to the first storage) for storing small sewing machine accessories (a plurality of presser foot and the like) is formed inside the auxiliary cover 70. A part of the storage 71*d* is openably covered by a lid member 72. By upwardly removing the lid member 72, the user can access and take out the small accessories stored in the storage 71*d*. When the lid member 72 is closed, the entire upper surface of the lid member 72 assumes a flat work table top. The storage 71*d* covering the Y-carriage mechanism 53 and the movable case 54 therefor from above is provided on the left end of the auxiliary cover 70.

Near the upper end of the right end wall in the front portion of the casing 71 of the auxiliary cover 70, an engagement pin 73 similar to the engagement pin 62 of the embroidery unit main body 40 is fixed horizontally in the rightward orientation. A conical guide portion 73*a* and an annular groove 73*b* are formed on the engagement pin 73. Furthermore, an engagement pin 74 is fixed horizontally in the rightward orientation is fixed near the upper end of the left end wall for the free arm engagement portion 71*f* of the casing 71. A conical guide portion 74*a* is formed on the engagement pin 74.

When the free arm 3 is attached to the auxiliary cover 70 for performing normal sewing as shown in FIG. 12, the engagement pin 73 is engaged with the uppermost engagement hole 2*a* of the bed main body 2, and the engagement pin 74 is engaged with the engagement hole 3*b* in the left end wall of the free arm 3. Also, when the auxiliary cover 70 is attached as shown in FIG. 3 for normal sewing, the engagement pin 73 is engaged with the lower most engagement hole 2*c* of the bed main body 2, and the engagement pin 74 is disposed below the free arm 3 without being engaged with any of the engagement holes.

Next, the lock mechanism 10 for locking the engagement pins 62 and 63 and the release mechanism 11 will be described hereinafter.

As shown in FIGS. 3 and 4, the lock mechanism 10 includes a support member 14, lock plate 12, helical extension spring 15, and the like. The lock plate 12 assumes a vertical disposition and is rotatably supported at the lateral mid portion thereof to the support member 14 by a vertically extending pin 13. The helical extension spring 15 is disposed between the right end of the lock plate 12 and a front wall of the bed main body 2, and elastically biases the lock plate 12 in the clockwise direction in FIG. 4.

An engagement plate 12*a* bent at a right angle is formed in the left end of the lock plate 12. Three U-shaped notched engagement portions (not shown) are formed on the engagement plate 12*a*. The notched engagement portions are engageable to the annular grooves 62*b*, 73*b* of the engagement pins 62 and 73 from the front when the engagement pins 62 and 73 are engaged with two of the three engagement holes 2*a*, 2*b*, and 2*c* of the bed main body.

As shown in FIG. 3, when the embroidery unit main body 40 and the auxiliary cover 70 are attached to the bed main body 2 upon embroidery sewing, the engagement pins 62 and 73 are inserted into the engagement holes 2*a* and 2*c* respectively and proceeds toward the engagement plate 12*a*. At this point, the lock plate 12 rotates counterclockwise in FIG. 4 resisting the biasing force of the helical extension spring 15 by a guiding operation of the guiding portions 62*a* and 73*a* of the engagement pins 62 and 73. When two of the notched engagement portions of the engagement plate 12*a* are engaged to annular grooves 63*b* and 73*b* of the engagement pins 62 and 73, the lock plate 12 returns to the position illustrated in FIG. 4 by the biasing force of the helical extension spring 15 and locks the engagement pins 62 and 73. As shown in FIG. 12, upon attaching the embroidery unit main body 40 and the auxiliary cover 70 to the bed main body 2 upon normal sewing, the lock mechanism 10 operates in the same manner and locks the engagement pins 62 and 73.

As shown in FIGS. 3 and 4, the release mechanism 11 unlocks the lock mechanism 10 and has the operation button 16 attached slidably in the longitudinal direction to a hole defined in a front wall 2*d* of the bed main body 2. The rear end of the operation button 16 is connected to a connection piece 18 fixed to the lock plate 12 between the pin 13 and the helical extension spring 15 by a vertical pin 17. Also, the front end of the operation button 16 protrudes to the front by a predetermined length from the front wall 2*d* of the bed main body 2.

Upon removing the embroidery unit main body 40 and the auxiliary cover 70 from the sewing machine bed 1, when the operation button 16 is pressed rearward by the user's finger tip, the lock plate 12 is rotated about the pin 13 counterclockwise in FIG. 4. Thus, the lock mechanism 10 is unlocked, and the embroidery unit main body 40 and the auxiliary cover 70 can be pulled to the left and removed from the sewing machine bed 1.

The operation and effect of the above described embroidery unit 30 will be described hereinafter.

Upon normal sewing, the embroidery unit main body 40 is attached to the sewing machine bed 1 in the normal sewing attachment position with the auxiliary cover 70 placed atop the embroidery unit main body 40. Under such state, the switch member 27 is maintained in the left position and the feed dog 22 is maintained in the feed dog operating position. Thus, the normal sewing can be carried out in which sewing is performed while feeding the cloth with the feed dog 22 of the cloth feed mechanism 23.

At this point, since the upper surface of the auxiliary cover 70 is substantially level with the upper surface of the sewing machine bed 1, a large work table top can be secured by the upper surfaces of the auxiliary cover 70 and the sewing machine bed 1. Thus, the workability of the normal sewing operation is improved and hence, considerably enhancing the usability of the sewing machine. Furthermore, since the embroidery unit main body 40 can be left attached to the sewing machine bed 1 even during normal sewing operation, no extra space is required for placing the embroidery unit main body 40.

Also, since the auxiliary cover 70 and the embroidery unit main body 40 are shaped substantially the same, when the auxiliary frame 70 is placed atop the embroidery unit main body 40, the engagement projections in the lower end of the auxiliary cover can be engaged with the engagement recess 41*b* of the embroidery unit main body 40. Thus, the auxiliary cover 70 and the embroidery unit main body 40 can be integrally attached to the sewing machine bed 1, with the auxiliary cover 70 securely positioned with respect to the embroidery unit main body 40.

Furthermore, when the auxiliary cover 70 and the embroidery unit main body 40 are attached to the sewing machine bed 1, since the engagement pins 62 and 73 are locked by the lock mechanism 10, stable attachment of the auxiliary cover 70 and the embroidery unit main body 40 is attained. Also, upon removing the auxiliary cover 70 and the embroidery unit main body 40 from the sewing machine bed 1, the lock mechanism 10 can be easily unlocked by the release mechanism 11 by pressing the operation button 16.

On the other hand, upon embroidery sewing, the embroidery unit main body 40 and the auxiliary cover 70 are attached to the sewing machine bed 1 with the embroidery unit main body 40 placed atop the auxiliary cover 70. At this point, since the upper surface of the embroidery unit main body 40 is substantially level with the upper surface of the sewing machine bed 1, a large work table top can be secured by the upper surfaces of the embroidery unit main body 40 and the sewing machine bed 1.

Under such state, the switch member 27 is switched to the right position and the feed dog 22 is switched to the feed dog non-operating position. Also, the Y-carriage mechanism 53 protrudes above the upper surface of the embroidery unit main body 40. Thus, embroidery sewing can be carried out in which the embroidery frame 61 is moved independently in the X and Y-directions by the X and Y-transfer mechanisms respectively by connecting the connection portion 61*c* of the embroidery frame 61 set with a cloth with the connection portion of the Y-carriage 53.

In this case also, when the embroidery unit main body 40 is placed atop the auxiliary frame 70, the engagement projections 41*i* in the lower end of the embroidery unit main body 40 can be engaged with the engagement recess 71*a* of the auxiliary cover 70. Thus, the embroidery unit main body 40 and the auxiliary cover 70 can be integrally attached to the sewing machine bed 1 with the embroidery unit main body 40 securely positioned with respect to the auxiliary cover 70.

Furthermore, even in case of embroidery sewing, when the auxiliary cover 70 and the embroidery unit main body 40 are attached to the sewing machine bed 1, since the engagement pins 62 and 73 are locked by the lock mechanism 10, stable attachment of the auxiliary cover 70 and the embroidery unit main body 40 is attained. Furthermore, since the auxiliary bed 70 can be left attached to the sewing machine bed 1 even during the embroidery sewing operation, no extra space is required for placing the auxiliary cover 70.

Also, upon removing the embroidery unit main body 40 and the auxiliary cover 70 and the from the sewing machine bed 1, the lock mechanism 10 can be easily unlocked by the release mechanism 11 by pressing the operation button 16.

Furthermore, when embroidery sewing is not performed, the embroidery frame 61 can be stored in the storage 41*f* of the embroidery unit main body 40 and small accessories such as presser foots can be stored in the storage 71*d* inside the auxiliary cover 70.

FIGS. 15 to 27 illustrate a second embodiment of the present invention. The portions that differ from the first embodiment will be described. The portions that are the same as the first embodiment are identified with the same reference characters.

An embroidery unit 30A attached to the sewing machine M in accordance with the present invention is detachably attached to the sewing machine bed 1. The embroidery unit 30A includes an X-transfer mechanism and a Y-transfer mechanism (both not shown) that transfer the embroidery frame 61 in the X-direction parallel to the lengthwise direction of the sewing machine bed 1 and the Y-direction perpendicular to the X-direction respectively; an embroidery unit main body 40A, a Y-carriage mechanism 53 provided so as to protrude from the embroidery unit main body 40A; an auxiliary table 80; and an auxiliary lid 92, or the like.

First, the auxiliary table 80 will be described in detail. As shown in FIGS. 15 to 20, the auxiliary table 80 is detachably attached to the front portion of the free arm 3 and functions as an extension to the work table top. When the auxiliary table 80 is attached to the front portion of the free arm 3, the upper portion of the auxiliary table 80 is substantially level with the sewing machine bed 1. The auxiliary table 80 is used by being attached to the sewing machine bed 1 (refer to FIG. 16) upon both embroidery and normal sewing.

The auxiliary table 80 is integrally molded from synthetic resin and has a table top forming portion 80*a* constituting the main body portion thereof, a left end extension plate 80*b*, and the front end guide plate 80*c*. A storage 80*d* for storing small accessories such as presser foots are provided inside the table top forming portion 80*a* as in the storage 71*d* in the first embodiment. An opening lid 80*e* capable of opening and closing the storage 80*d* is provided on the upper surface of the storage 80*d*.

Figure 18:
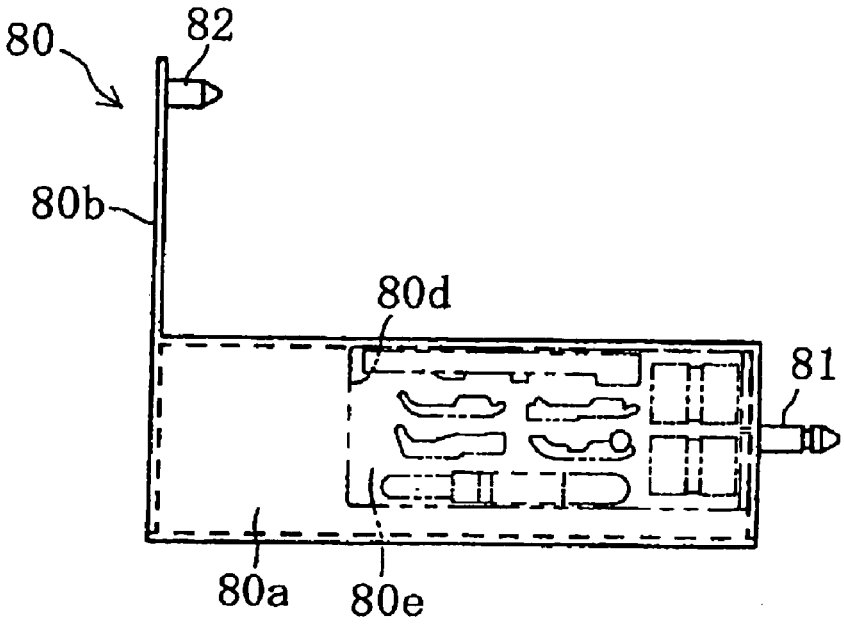
FIG. 18 is a plan view of the auxiliary table.
Figure 19:
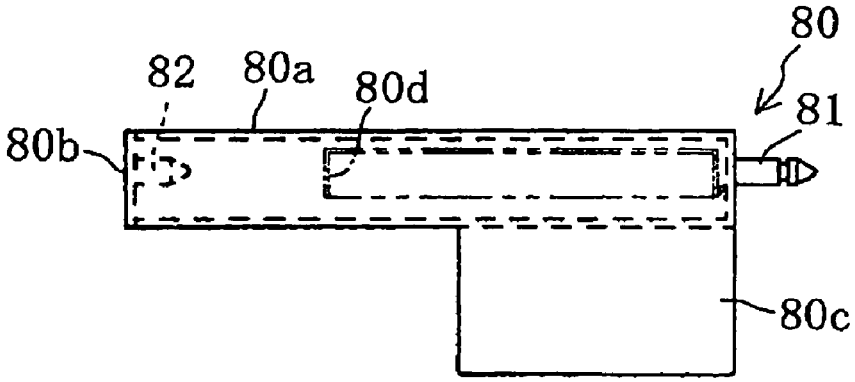
FIG. 19 is a front view of the auxiliary table.
Figure 20:
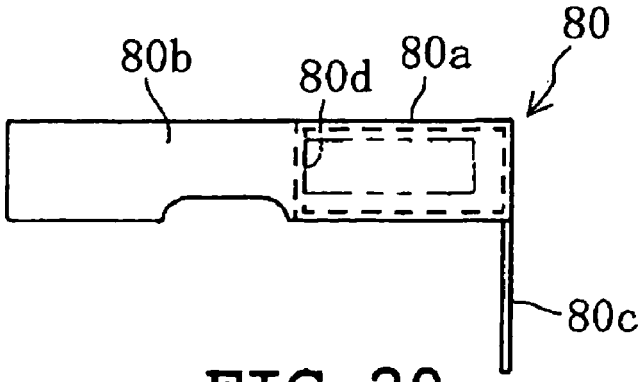
FIG. 20 is a left side view of the auxiliary table.

The left end extension plate 80*b* is formed to extend rearward from a left end wall of the auxiliary table 80 (refer to FIG. 18). The front end guide plate 80*c* is formed to extend downward from the substantial right half of the front end wall of the auxiliary table 80 (refer to FIGS. 19 and 20). A bottom plate 20 is disposed below the free arm 3 spaced apart by a predetermined distance, and the lower end of the front end guide plate 80*c* extends to a position abutting the upper surface of the bottom plate 20. An engagement pin 81 similar to the engagement pin 73 of the first embodiment is provided on a right end wall of the auxiliary table 80. Also, an engagement pin 82 similar to the engagement pin 74 of the first embodiment is provided on the left end extension plate 80*b*.

Figure 16:
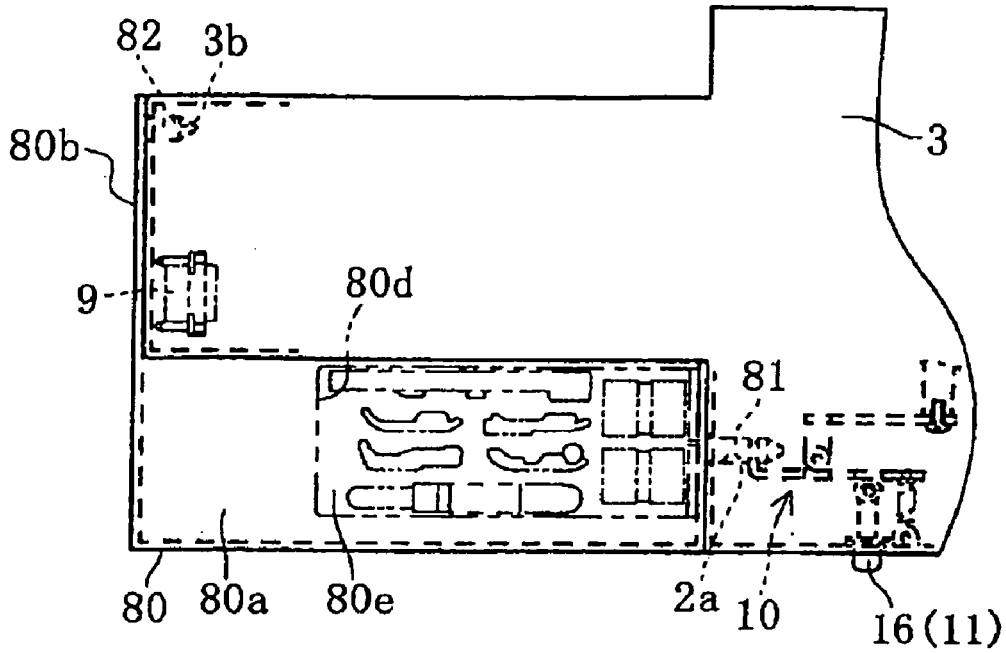
FIG. 16 is a plan view of the sewing machine bed attached with the auxiliary table.
Figure 17:
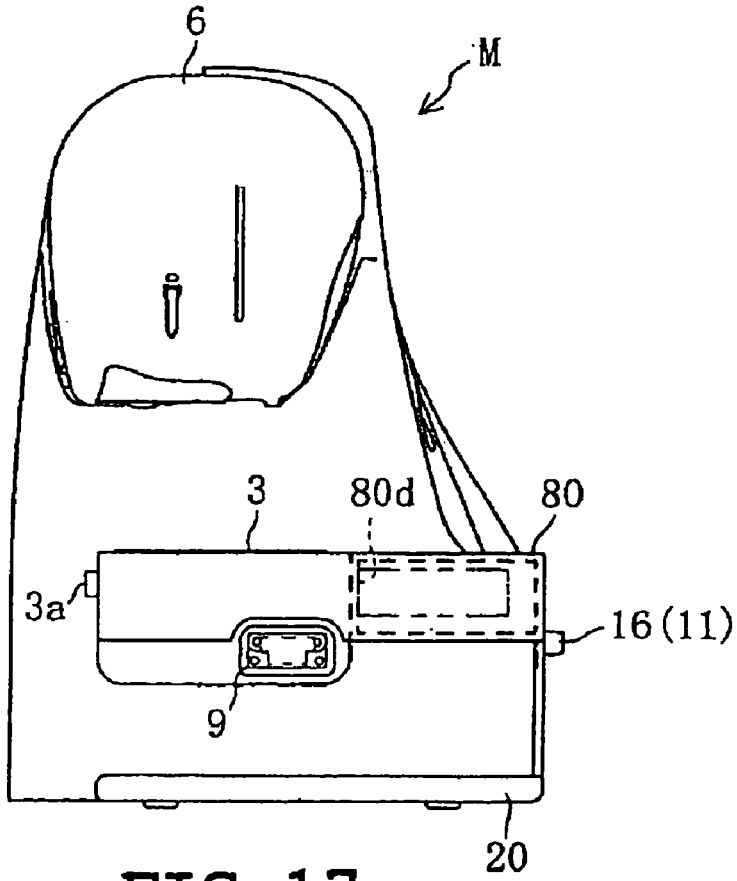
FIG. 17 is a left side view of the sewing machine.

As shown in FIGS. 16 and 17, when the auxiliary table 80 is attached to the sewing machine bed 1, the engagement pin 82 is engaged with the engagement hole 3*b* of the free arm 3 and the engagement pin 81 is engaged with the engagement hole 2*a* of the bed main body 2. A lock mechanism that locks the engagement pin 81 engaged with the engagement hole 2*a* and a release mechanism 11 that unlocks the lock mechanism 10 is provided on the bed main body 2.

Next, the embroidery unit main body 40A will be described. As shown in FIGS. 21 to 25, the embroidery unit main body 40A has a casing 90 made of synthetic resin, and the X-transfer mechanism and the Y-transfer mechanism (both not shown) are disposed inside the casing 90.

The casing 90 has a front lowered step 90*a*, front elevated step 90*b*, a rear elevated step 90*c* and a left lowered step 90*d*. An oblong space surrounded by the front lowered step 90*a*, rear elevated step 90*c* and the left lowered step 90*d* is defined as a free arm engagement portion 90*f*. When the embroidery unit main body 40A is attached to the sewing machine bed 1, the upper surfaces of the front elevated step 90*b* and the rear elevated step 90*c* are substantially level with the sewing machine bed 1 and are used as a work table top along with the sewing machine bed 1. At this point, the left lowered step 90*d* is positioned to the left from the left end of the free arm 3.

The embroidery unit main body 40A is attached to the sewing machine bed 1 from the left with the auxiliary table 80 attached to the sewing machine bed 1. Thus, a slit 90*e* to which the front end guide plate 80*c* of the auxiliary table 80 is fitted is formed in the portion between the front lowered step 90*a* and the front elevated step 90*b* of the casing 90.

The portion of the embroidery unit main body 40A corresponding to the front lowered step 90*a* and the left lowered step 90*d* is a main portion 91 to which the X-transfer mechanism and the Y-transfer mechanism is equipped. More concretely, the X-transfer mechanism is equipped inside the front portion of the front lowered step 90*a* and the left lowered step 90*d*. The Y-transfer mechanism is equipped inside the left lowered step 90*d*. The Y-carriage mechanism 53 protrudes from the upper surface of the left lowered step 90*d* and the Y-carriage mechanism 53 and the movable case 54 therefor is moved in the X and Y-directions along the upper surface of the left lowered step 90*d*. Therefore, the upper surface of the left lowered step 90*d* is the moving range of the Y-carriage 53 and the movable case 54 therefor.

Figure 21:
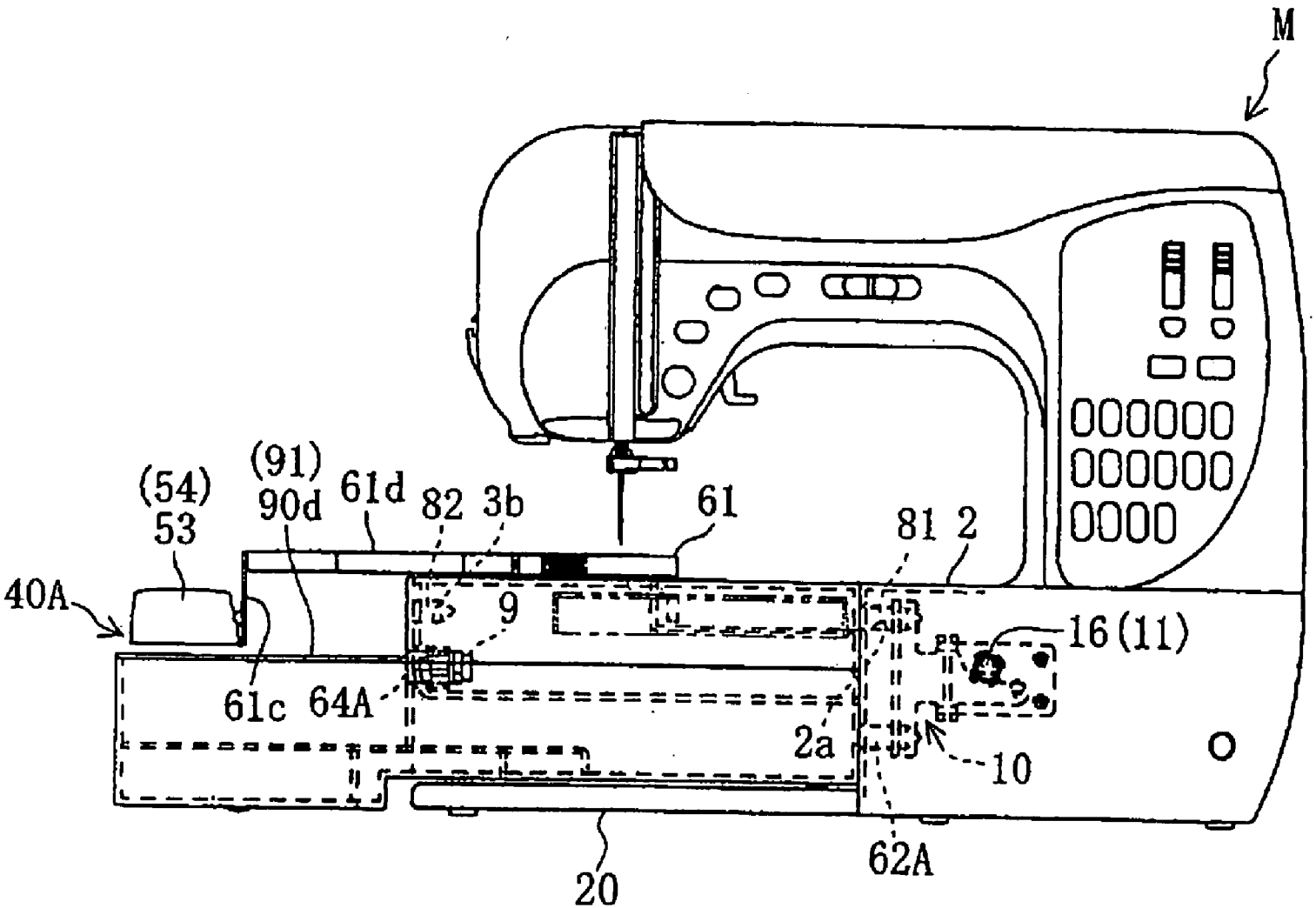
FIG. 21 is a front view of the sewing machine bed attached with the embroidery unit main body and the auxiliary table.

As shown in FIG. 21, the embroidery frame 61 used in the embroidery unit 30A has a frame main body 61*d* and the connection portion 61*c* extending downward from the left end thereof. The embroidery frame 61 is connected to the Y-carriage 53 via the connection portion 61*c* and is moved along the upper surfaces of the free arm 3, the front elevated step 90*b* and the rear elevated step 90*c*.

An engagement pin 62A similar to the engagement pin 62 is provided on the right end wall of the front lowered step 90*a*. When the embroidery unit main body 40A is attached to the sewing machine bed 1, the engagement pin 62A is engaged with the engagement hole 2*c* of the bed main body 2. The engagement pin 62A engaged with the engagement hole 2*c* is locked by the lock mechanism 10 and unlocked by the release mechanism 11. A connector 64A similar to the connector 64 is provided on the left lowered step 90*d* of the embroidery unit main body 40A. When the embroidery unit main body 40A is attached to the sewing machine bed 1, the connector 64A is electrically connected to the connector 9 on the left end of the free arm 3.

Regarding the casing 90, an opening not shown for inserting the fingertips is formed in a lower portion of the rear elevated step 90*c* for manually operating the switch member 27 for switching the position of the feed dog 22. The switch member 27 can be operated from the opening.

Next, the auxiliary lid 92 will be described.

The auxiliary lid 92 in a box-form has an opened lower end and is detachably attached to the upper surface of the left lowered step 90*d* of the embroidery unit main body 40A so as to cover the Y-carriage mechanism 53 and the moving range thereof from above. The auxiliary lid 92 has a flat upper surface and can be used as a work table. That is, the auxiliary lid 92 functions as an extension to the work table. A Y-carriage mechanism storage 92*a* for storing the Y-carriage 53 and the movable case 54 therefor is formed inside the left portion of the auxiliary lid 92. Though not shown, an outer peripheral engagement portion engageable with the lower end of the auxiliary lid 92 is formed on the outer peripheral edge of the upper end of the left lowered step 90*d* of the embroidery unit main body 40A. When the auxiliary lid 92 is attached to the left lowered step 90*d* for performing the normal sewing operation, the upper surface of the auxiliary lid 92 and the upper surface of the sewing machine bed 1 are substantially at level.

Next, the operation and effect of the above constructed embroidery unit 30A will be described.

When neither of the auxiliary table 80, the embroidery unit main body 40A, and the auxiliary lid 92 is attached to the sewing machine bed 1, the free arm 3 can be used to perform normal sewing operation on a cylindrical object.

Figure 15:
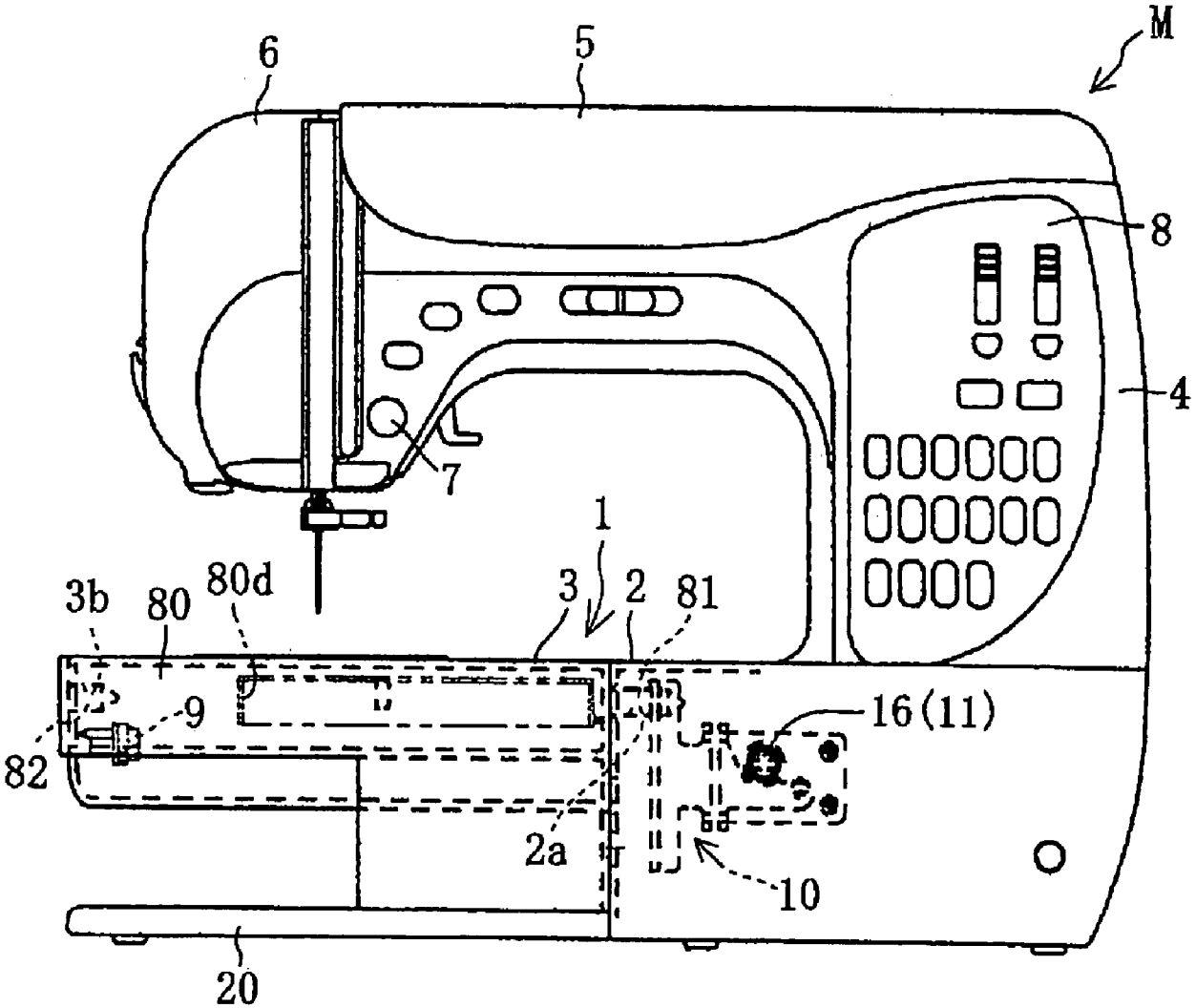
FIG. 15 is a front view of a sewing machine attached with an auxiliary table indicting a second illustrative aspect of the present disclosure.

In case of performing normal sewing operation on a non-cylindrical object, as shown in FIGS. 15 and 16, the auxiliary table 80 is attached on the sewing machine bed 1. Thus, work area is extended beyond the front of the free arm 3, improving the workability and usability.

Figure 22:
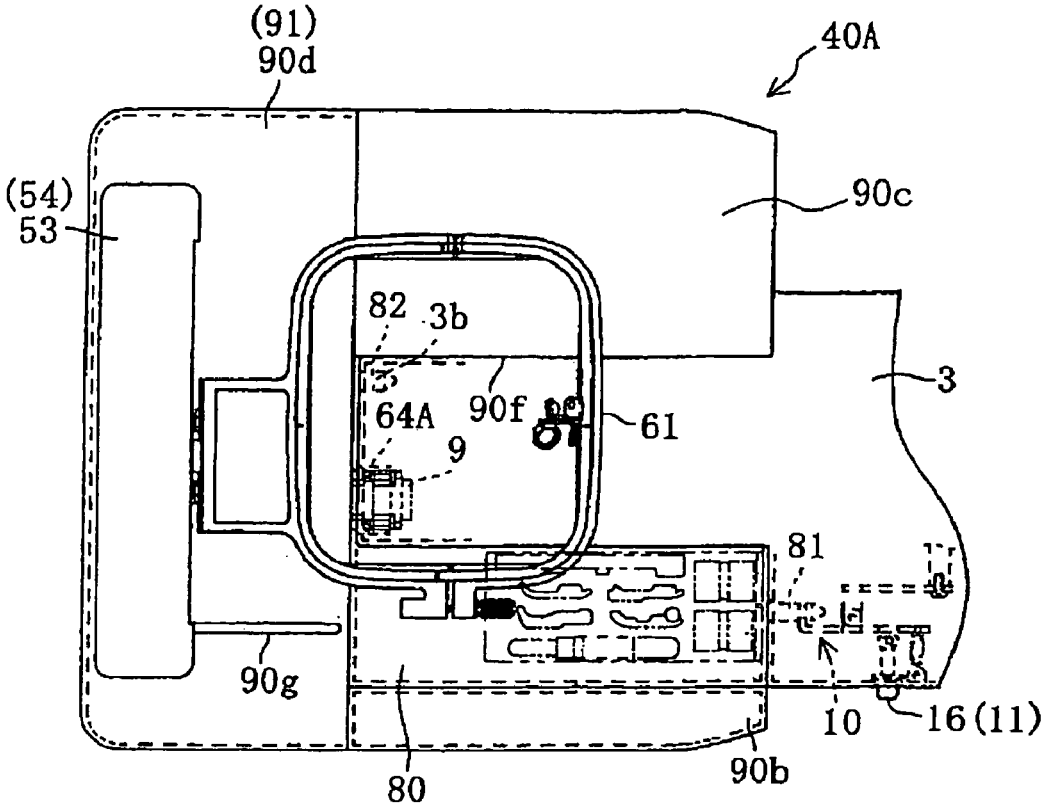
FIG. 22 is a plan view of the sewing machine bed attached with the embroidery unit main body and the auxiliary table.
Figure 23:
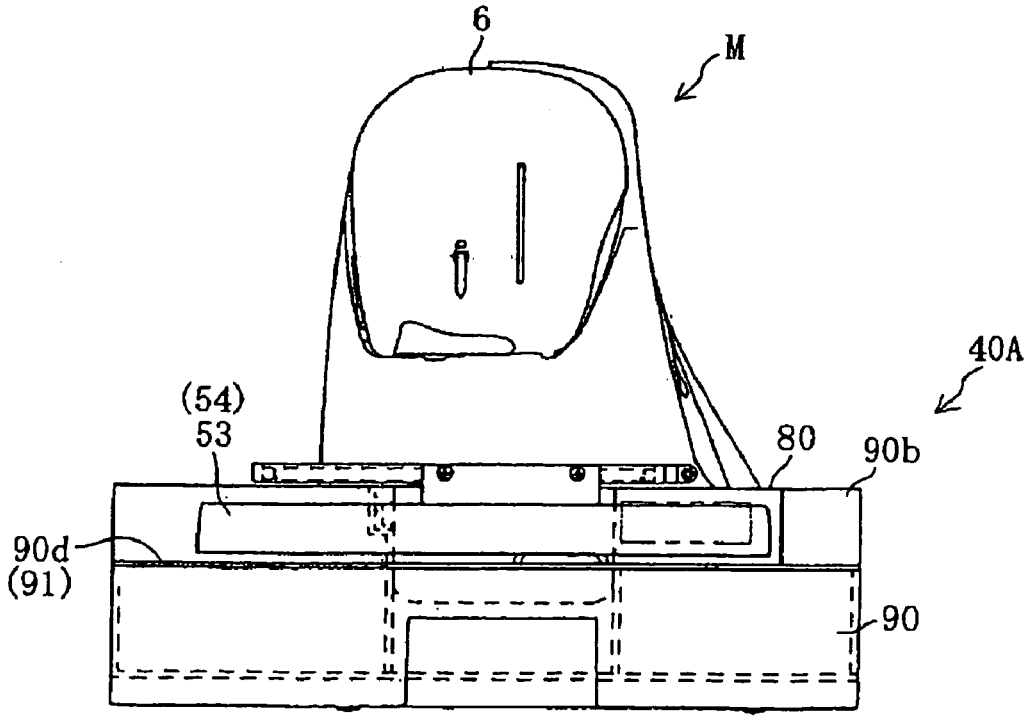
FIG. 23 is a left side view of the sewing machine bed attached with the embroidery unit main body and the auxiliary table.
Figure 24:
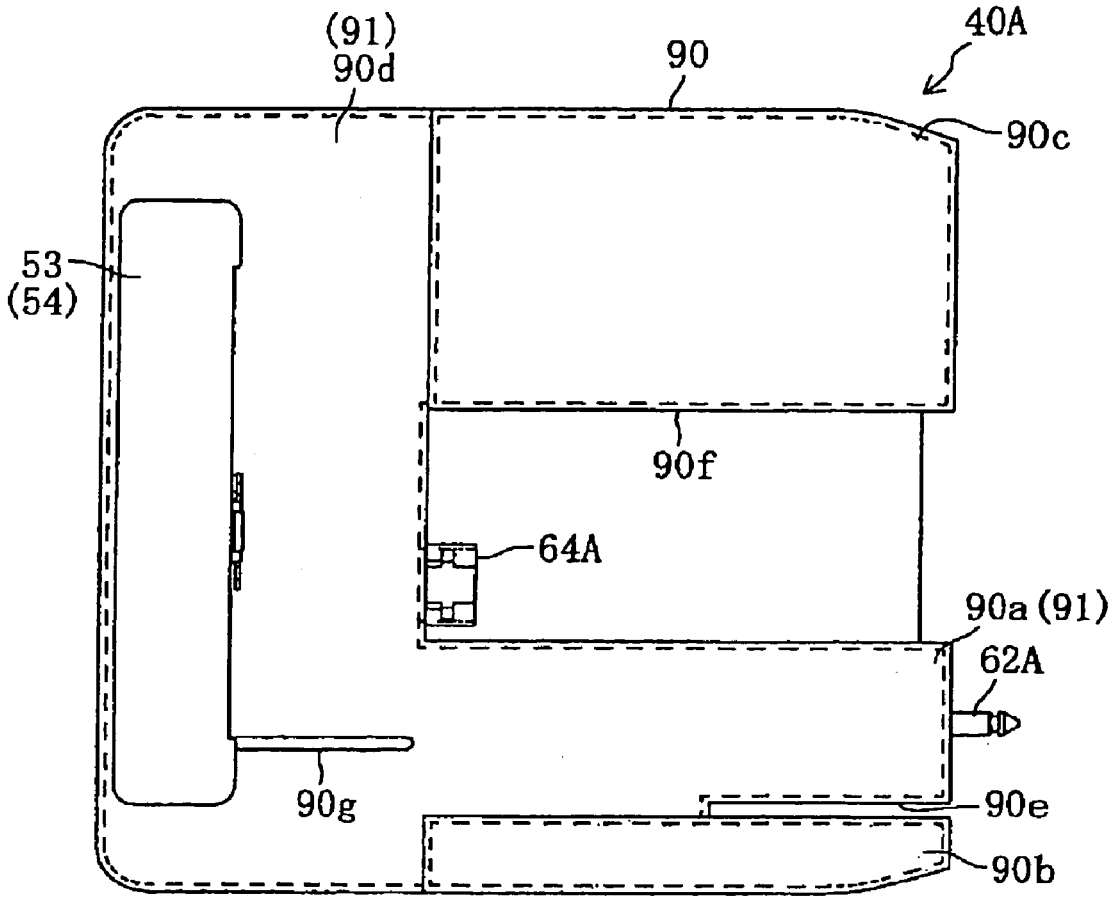
FIG. 24 is a plan view of the embroidery unit main body.
Figure 25:
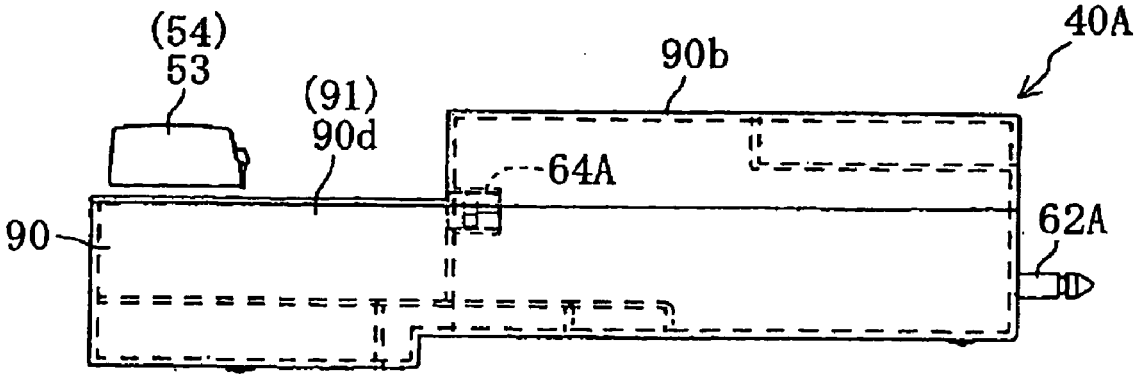
FIG. 25 is a front view of the embroidery unit main body.

In case of embroidery sewing, as shown in FIG. 22, the embroidery unit main body 40A is attached to the sewing machine bed 1 with the auxiliary table 80 attached. At this point, the upper surfaces of the front elevated step 90*b* and the rear elevated step 90*c* are substantially level with the sewing machine bed 1. Thus, work area is extended beyond the rear portion of the free arm 3 and the front portion of the auxiliary table 80. That is, a work table having a significantly increased longitudinal width is formed by the free arm 3, the auxiliary table 80, and the embroidery unit 40A, improving the workability and the usability.

Figure 26:
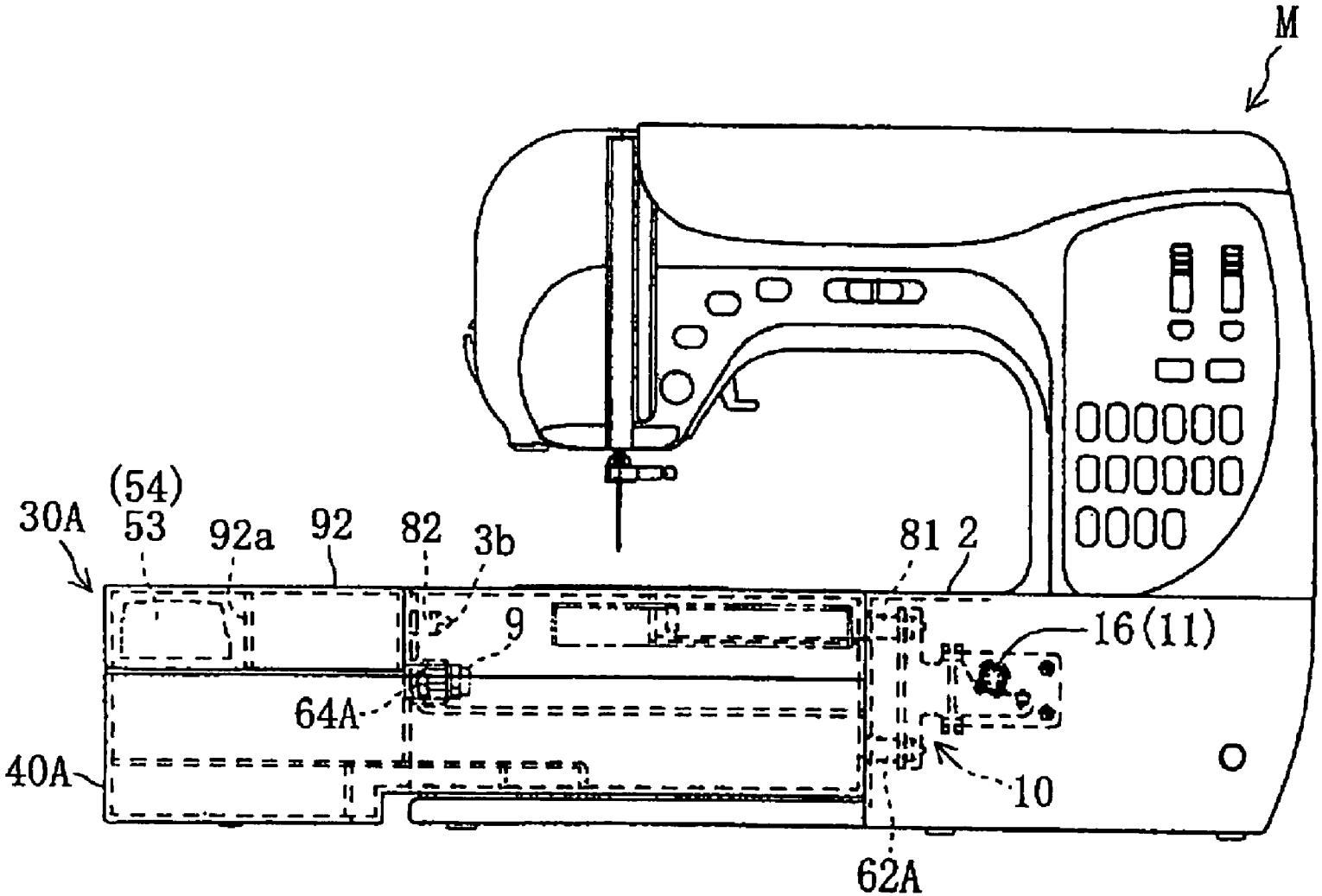
FIG. 26 is a front view of the sewing machine in FIG. 15 attached with the embroidery unit main body, the auxiliary table and an auxiliary lid.
Figure 27:
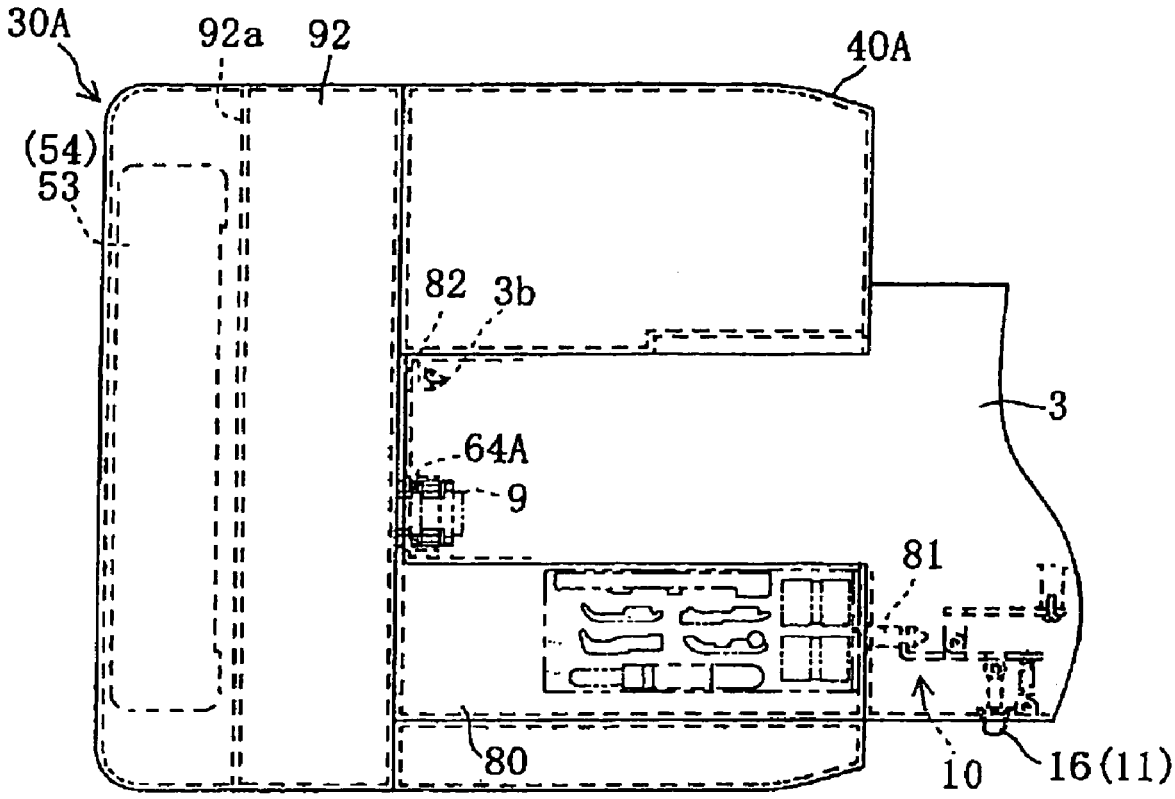
FIG. 27 is a plan view of the sewing machine bed attached with the embroidery unit main body, the auxiliary table, and the auxiliary cover.

Also, in case of performing normal sewing requiring large work area, as shown in FIGS. 26 and 27, the auxiliary lid 92 is attached to the embroidery unit main body 40A with the auxiliary table 80 attached. Since the upper surface of the auxiliary lid 92 attached on the embroidery unit main body 40A is substantially level with the upper surface of the sewing machine bed 1, the upper surface of the auxiliary lid 92 can also be used as a work area. Therefore, the work area continuously formed on the upper surface of the sewing machine bed 1 can be considerably increased, providing improved workability and usability.

Thus, since the upper surface of the main portion 91 of the embroidery unit main body 40A is formed one step lower than the sewing machine bed 1, normal sewing operation can be performed with the embroidery unit main body 40A attached by covering the Y-carriage mechanism 53 with the auxiliary lid 92. Also, sufficient work area can be secured by the embroidery unit main body 40A and the auxiliary lid 92.

The present invention is not limited to the above described embodiments but can be modified as follows.

In order to increase the embroidery area upon embroidery sewing, the longitudinal and/or the lateral width of the embroidery unit 30 or the embroidery unit main body 40 may be increased.

Also, the ratio of height (thickness) of the embroidery unit main body 40 and the height (thickness) of the auxiliary cover 70 can be changed accordingly.

The longitudinal width of the rear elevated step 90*c* and the left lowered step 90*d* of the embroidery unit main body 40 of the embroidery unit 30A according to the second embodiment may be reduced.

Also, the X-transfer mechanism may be disposed inside the rear elevated step 90*c* and the left lowered step 90*d*.

The embroidery unit according to the present invention may be constructed only by an embroidery unit main body capable of being attached either in the embroidery attachment position or in the normal sewing attachment position.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

We claim:

1. An embroidery unit detachably attached to a sewing machine bed provided with a cloth feed mechanism including a feed dog and having an X-transfer mechanism and a Y-transfer mechanism that carries an embroidery frame in an X-direction parallel to a lengthwise direction of the sewing machine bed and a Y-direction perpendicular to the X-direction, the embroidery unit comprising:

an embroidery unit main body attached to the sewing machine bed either in an embroidery attachment position for performing embroidery sewing with an embroidery frame or in a normal sewing attachment position for performing a sewing operation by the feed dog of the cloth feed mechanism; and an auxiliary cover that is selectively placeable above the embroidery unit main body and selectively placeable below the embroidery unit main body.

2. The embroidery unit according to claim 1, wherein the embroidery attachment position is located above the normal sewing attachment position.

3. The embroidery unit according to claim 2, wherein the upper surface of the embroidery unit main body is substantially level with the upper surface of the sewing machine bed when the embroidery unit main body is attached in the embroidery attachment position.

4. The embroidery unit according to claim 2, wherein the auxiliary cover is capable of being placed below the embroidery unit main body when the embroidery unit main body is attached in the embroidery attachment position.

5. The embroidery unit according to claim 1, further comprising a Y-carriage mechanism provided in a Y-transfer mechanism and protruding above an upper surface of the embroidery unit main body and the auxiliary cover is respectively attachable to the sewing machine bed. c

6. The embroidery unit according to claim 5, further comprising:

a plurality of engagement pins provided on the auxiliary cover, wherein the sewing machine bed includes:

a plurality of engagement holes with which the engagement pins are engaged when the auxiliary cover is attached to the sewing machine bed, a lock mechanism locking at least one of the engagement pins engaged with the engagement holes, and a release mechanism capable of unlocking the lock mechanism.

7. The embroidery unit according to claim 5, wherein an upper surface of the auxiliary cover is substantially level with the sewing machine bed when the embroidery unit main body is attached in the normal sewing attachment position with the auxiliary cover placed above the embroidery unit main body.

8. The embroidery unit according to claim 1, wherein an electrical connector is provided in the embroidery unit main body and the sewing machine bed respectively that become connected when the embroidery unit main body is attached in the embroidery attachment position, and unconnected when the embroidery unit main body is attached in the normal sewing attachment position.

9. The embroidery unit according to claim 1, further comprising:

a switch member switching the feed dog between a feed dog operating position capable of cloth feeding and a feed dog non-operating position incapable of cloth feeding, wherein when the embroidery unit main body is attached in the embroidery attachment position, the embroidery unit main body operates the switch member and switches the feed dog to the feed dog non-operating position, and wherein when the embroidery unit main body is attached in the normal sewing attachment position, the embroidery unit main body does not operate the switch member and the feed dog is positioned in the feed dog operating position.

10. The embroidery unit according to claim 1, further comprising a first storage portion capable of storing sewing machine accessories and a second storage portion capable of storing the embroidery frame, the first storage portion and the second storage portion being provided in the auxiliary cover and the embroidery machine main body respectively.

11. The embroidery unit according to claim 1, wherein the sewing machine bed has an engagement hole, and the embroidery unit main body has a plurality of engagement pins engaging with the engagement hole when the embroidery unit main body is attached to the sewing machine bed.

12. The embroidery unit according to claim 11, wherein the sewing machine bed is provided with a lock mechanism locking at least one of the engagement pins engaged with the engagement hole and a release mechanism capable of unlocking the lock mechanism.

13. An embroidery unit detachably attached to a sewing machine bed provided with a leftwardly extending free arm and having an X-transfer mechanism and a Y-transfer mechanism that carries an embroidery frame in an X-direction parallel to a lengthwise direction of the sewing machine bed and a Y-direction perpendicular to the X-direction, the embroidery unit comprising:

an embroidery unit main body including the X-transfer mechanism and the Y-transfer mechanism and attached detachably to the sewing machine bed and having a main portion, when attached to the sewing machine bed, is located below an upper surface thereof, the main portion being provided with the X-transfer mechanism and the Y-transfer mechanism;

a Y-carriage mechanism provided on the Y-transfer mechanism so as to protrude above the main portion and moved in the X-direction in a position further left from a left end of the free arm; and an auxiliary lid attached detachably to an upper surface of the embroidery unit main body so as to cover the Y-carriage mechanism such that an upper surface of the auxiliary lid and an upper surface of the sewing machine bed is substantially at level.

14. The embroidery unit according to claim 13, further comprising an auxiliary table detachably attached to the free arm and the embroidery unit main body is attachable to the free arm with the auxiliary table attached thereto.

15. An auxiliary cover attached to an embroidery unit detachably attached to a sewing machine bed having an X-transfer mechanism and a Y-transfer mechanism that carries an embroidery frame in an X-direction parallel to a lengthwise direction of the sewing machine bed and a Y-direction perpendicular to the X-direction, the auxiliary cover comprising:

a cover main body placed above the embroidery unit and attached to the sewing machine bed with the embroidery unit, at which point an upper surface of the auxiliary cover is substantially level with an upper surface of the sewing machine bed.

16. A sewing machine having a sewing machine bed provided with a cloth feed mechanism including a feed dog, the sewing machine comprising:

an embroidery unit having an X-transfer mechanism and a Y-transfer mechanism that carries an embroidery frame in an X-direction parallel to a lengthwise direction of the sewing machine bed and a Y-direction perpendicular to the X-direction, wherein the embroidery unit being capable of being detachably attached to the sewing machine bed in an embroidery attachment position for performing embroidery sewing with an embroidery frame and a normal sewing attachment position for performing a sewing operation by the feed dog of the cloth feed mechanism; and an auxiliary cover that is selectively placeable above the embroidery unit and selectively placeable below the embroidery unit.

17. The sewing machine according to claim 16, wherein an electrical connector is provided in the embroidery unit and the sewing machine bed respectively that become connected when the embroidery unit is attached in the embroidery attachment position, and unconnected when the embroidery unit is attached in the normal sewing attachment position.

18. The sewing machine according to claim 16, further comprising:

a switch member switching the feed dog between a feed dog operating position capable of cloth feeding and a feed dog non-operating position incapable of cloth feeding, wherein when the embroidery unit is attached in the embroidery attachment position, the embroidery unit operates the switch member and switches the feed dog to the feed dog non-operating position, and wherein when the embroidery unit is attached in the normal sewing attachment position, the embroidery unit does not operate the switch member and the feed dog is positioned in the feed dog operating position.

19. The sewing machine according to claim 16, further comprising:

a plurality of engagement pins provided on the embroidery unit, wherein the sewing machine bed includes:

a plurality of engagement holes with which the engagement pins are engaged when the embroidery unit is attached to the sewing machine bed, a lock mechanism provided on the sewing machine bed and locking at least one of the engagement pins engaged with the engagement holes, and a release mechanism provided on the sewing machine bed and capable of unlocking the lock mechanism.

20. The sewing machine according to claim 16, further comprising:

a plurality of engagement pins, wherein the auxiliary cover placed above or below the embroidery unit and attached to the sewing machine bed with the embroidery unit, wherein the sewing machine bed includes:

a plurality of engagement holes engaging with the engagement pins when the auxiliary cover is attached to the sewing machine bed, a lock mechanism locking at least one of the engagement pins engaged with the engagement holes, and a release mechanism capable of unlocking the lock mechanism.

21. An embroidery unit detachably attached to a sewing machine bed provided with a cloth feed mechanism including a feed dog having an X-transfer mechanism and a Y-transfer mechanism that carries an embroidery frame in an X-direction parallel to a lengthwise direction of the sewing machine and a Y-direction perpendicular to the X-direction, the embroidery unit comprising:

an embroidery unit main body attached to the sewing machine bed either in an embroidery attachment position for performing embroidery sewing with an embroidery frame or in a normal sewing attachment position for performing a sewing operation by the feed dog of the cloth feed mechanism; and a switch member switching the feed dog between a feed dog operating position where cloth feeding is allowed and a feed dog non-operating position where cloth feeding is disallowed, wherein when the embroidery unit main body is attached to the embroidery attachment position, the embroidery unit main body operates the switch member so that the feed dog is switched to the feed dog non-operating position, and when the embroidery unit main body is attached to the normal sewing attachment position, the embroidery unit main body is disallowed to operate the switch member such that the feed dog is positioned in the feed dog operation position.

22. A sewing machine having a sewing machine bed provided with a cloth feed mechanism including a feed dog, the sewing machine comprising:

an embroidery unit having an X-transfer mechanism and a Y-transfer mechanism that carries an embroidery frame in an X-direction parallel to a lengthwise direction of the sewing machine bed and a Y-direction perpendicular to the X-direction; and a switch member switching the feed dog between a feed dog operating position where cloth feeding is allowed and a feed dog non-operating position where cloth feeding is disallowed, wherein the embroidery unit is capable of being detachably attached to the sewing machine bed in an embroidery attachment position for performing embroidery sewing with an embroidery frame and a normal sewing attachment position for performing a sewing operation by the feed dog of the cloth feed mechanism, and wherein when the embroidery unit main body is attached to the embroidery attechment position, the embroidery unit main body operates the switch member so that the feed dog is switched to the feed dog non-operating position, and when the embroidery unit main body is attached to the normal sewing attachment position, the embroidery unit main body is disallowed to operate the switch member suchthat the feed dog is positioned in the feed dog operating position.

* * * * *